US009211714B2

(12) United States Patent
Kondo

(10) Patent No.: US 9,211,714 B2
(45) Date of Patent: Dec. 15, 2015

(54) LIQUID EJECTING HEAD AND LIQUID EJECTING APPARATUS

(71) Applicant: Seiko Epson Corporation, Tokyo (JP)

(72) Inventor: Yoichiro Kondo, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/670,946

(22) Filed: Mar. 27, 2015

(65) Prior Publication Data

US 2015/0273827 A1 Oct. 1, 2015

(30) Foreign Application Priority Data

Mar. 28, 2014 (JP) ..... 2014-070449

(51) Int. Cl.
*B41J 2/14* (2006.01)

(52) U.S. Cl.
CPC ..... *B41J 2/1433* (2013.01); *B41J 2002/14491* (2013.01)

(58) Field of Classification Search
CPC ... B41J 2/1433; B41J 2/17523; B41J 2/17513
USPC ..... 347/50
See application file for complete search history.

(56) References Cited

FOREIGN PATENT DOCUMENTS

JP 2007-136701 A 6/2007

*Primary Examiner* — Alessandro Amari
*Assistant Examiner* — Michael Konczal
(74) *Attorney, Agent, or Firm* — Harness, Dickey & Pierce, P.L.C.

(57) ABSTRACT

Provided is a liquid ejecting head including: a plurality of actuator units, each including a connection terminal row; an interconnection substrate which is disposed to face the plurality of actuator units, is electrically connected to the connection terminal row of each of the plurality of actuator units, and extends in a second direction intersecting a first direction that is a transporting direction of a recording sheet; an external connection terminal row which is provided to the interconnection substrate; and a plurality of liquid flow passages which supply a liquid to each of the plurality of actuator units. The plurality of liquid flow passages are arranged on an outer side of the interconnection substrate in the first direction, and the external connection terminal row is arranged between the plurality of liquid flow passages in the second direction.

5 Claims, 16 Drawing Sheets

LIQUID EJECTING HEAD AND LIQUID EJECTING APPARATUS

The entire disclosure of Japanese Patent Application No. 2014-070449, filed Mar. 28, 2014 is expressly incorporated by reference herein.

BACKGROUND

1. Technical Field

The present invention relates to a liquid ejecting head, and a liquid ejecting apparatus, and more particularly, to an ink jet type recording head that ejects ink as a liquid, and an ink jet type recording apparatus.

2. Related Art

As a liquid ejecting head, for example, there is known an ink jet type recording head including a head main body that deforms a pressure generating chamber communicating with a nozzle opening, through which ink droplets are ejected, by using a pressure generating unit such as a piezoelectric element to eject ink droplets from the nozzle opening, and a flow passage member that constitutes a flow passage of ink that is supplied to the head main body.

The head main body is connected to the flow passage member, ink is supplied from the flow passage to the head main body, or the ink is discharged from the head main body to the flow passage. In addition, an opening, into which a flexible interconnection substrate is inserted so as to pass therethrough, is provided to the flow passage member so as to pass therethrough in a thickness direction. The flexible interconnection substrate is inserted into the opening so as to pass therethrough, and is connected to the pressure generating unit of the head main body through a lead electrode.

In addition, in a case of forming a line head in which a plurality of heads are arranged in a line in a zigzag type (for example, refer to JP-A-2007-136701), it is necessary to determine how to arrange interconnections configured to transmit an external signal to the flexible substrate in addition to the flexible interconnection substrate that is connected to the head main body. In addition, in such a line head, a size in a paper transporting direction further increases for realization of multicolor, but paper transportation is not stably performed. Accordingly, printing quality deteriorates. As a result, special construction is necessary to stably transport sheets of paper.

Accordingly, in the liquid ejecting head, there is a demand for a decrease in dimensions in the paper transporting direction as much as possible, and necessity for the decrease has increased together with a demand for miniaturization that is required together with high resolution.

In addition, the problems also exist in not only the ink jet type recording head that ejects ink, but also in a liquid ejecting head and a liquid ejecting apparatus which ejects a liquid other than the ink.

SUMMARY

An advantage of some aspects of the invention is to provide a liquid ejecting head and a liquid ejecting apparatus in which dimensions in a paper transporting direction are made as small as possible.

According to an aspect of the invention, there is provided a liquid ejecting head including: a plurality of actuator units, each including a connection terminal row; an interconnection substrate which is disposed to face the plurality of actuator units, is electrically connected to the connection terminal row of each of the plurality of actuator units, and extends in a second direction intersecting a first direction that is a transporting direction of a recording sheet; an external connection terminal row which is provided to the interconnection substrate, and supplies a signal supplied from the outside to each of the plurality of actuator units through the interconnection substrate; and a plurality of liquid flow passages which supply a liquid to each of the plurality of actuator units from a side opposite to a side in which the plurality of actuator units are disposed with the interconnection substrate set as a reference. The plurality of liquid flow passages are arranged on an outer side of the interconnection substrate in the first direction, and the external connection terminal row is arranged between the plurality of liquid flow passages in the second direction.

According to this aspect, since the external connection terminal row is arranged on an outer side in the transporting direction of the interconnection substrate which is electrically connected to the connection terminal row of each of the plurality of actuator units and which extends in the second direction intersecting the first direction that is the transporting direction of the recording sheet, and each of the liquid flow passages is arranged on both outer sides of the external connection terminal row in the second direction, it is possible to realize miniaturization as a whole. Particularly, it is possible to shorten a dimension in the transporting direction, and thus high transportation accuracy of the recording sheet is secured, and thus it is possible to improve printing quality.

Here, it is preferable that the plurality of liquid flow passages are arranged on both outer sides of the interconnection substrate in the first direction, the external connection terminal row is arranged in a region between the plurality of liquid flow passages in the second direction by being divided into parts on both sides of the interconnection substrate in the first direction, and each of the divided external connection terminal rows is arranged between the plurality of liquid flow passages in the second direction. According to this configuration, since the external connection terminal row is arranged by being divided into parts on both outer sides of the interconnection substrate in the transporting direction, it is possible to realize miniaturization as a whole, and particularly, it is possible to cope with high density of the actuator units while maintaining the short dimension in the transporting direction.

In addition, it is preferable that one of the divided external connection terminal rows is a control system external connection terminal row that supplies a control signal configured to control a semiconductor device that is mounted on the plurality of actuator units, and the other is a drive system external connection terminal row that supplies a control signal configured to drive a drive element that is provided to the plurality of actuator units. According to this, it is possible to realize supply of the control signal and the drive signal to the actuator units while realizing the miniaturization.

In addition, it is preferable that each of the connection terminal rows is electrically connected to the interconnection substrate in a direction that is parallel with or inclined to the first direction. According to this configuration, it is possible to further reduce the dimension in the transporting direction.

According to another aspect of the invention, there is provided a liquid ejecting apparatus including the liquid ejecting head.

According to this aspect, since the external connection terminal row is arranged on an outer side in the transporting direction of the interconnection substrate which is electrically connected to the connection terminal row of each of the plurality of actuator unit and which extends in the second direction intersecting the first direction that is the transporting direction of the recording sheet, and each of the liquid flow passages is arranged on both outer sides of the external connection terminal row in the second direction, it is possible to realize miniaturization as a whole. Particularly, it is possible to realize a liquid ejecting apparatus in which a dimension in the transporting direction is shortened, and thus high transportation accuracy of the recording sheet is secured, and as a result, printing quality is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the basis of embodiments.

First Embodiment

Figure 1:
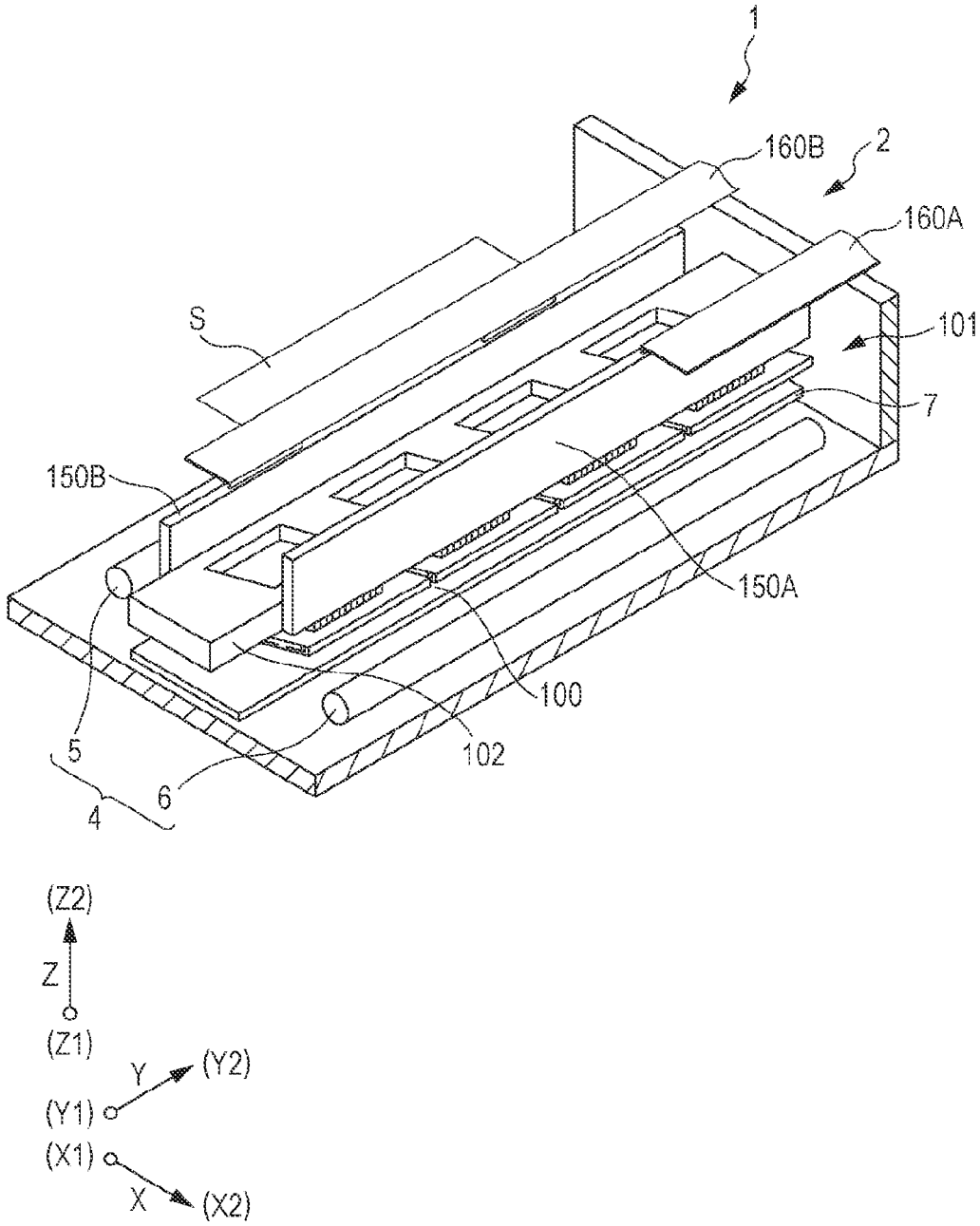
FIG. 1 is a schematic perspective view of a recording apparatus according to a first embodiment of the invention.

The invention will be described in detail on the basis of an embodiment. An ink jet type recording head is an example of a liquid ejecting head, and may be simply referred to as a recording head. An ink jet type recording head unit is an example of a liquid ejecting head unit, and may be simply referred to as a head unit. An ink jet type recording apparatus is an example of a liquid ejecting apparatus. FIG. 1 is a perspective view illustrating a schematic configuration of an ink jet type recording apparatus according to this embodiment.

As illustrated in FIG. 1, an ink jet type recording apparatus 1 is a so-called line type recording apparatus which includes a head unit 101, and transports a recording sheet S such as a sheet of paper that is a medium to be subjected to injection so as to perform printing.

Specifically, the ink jet type recording apparatus includes an apparatus main body 2, a head unit 101 including a plurality of recording heads 100, a transporting unit 4 that transports the recording sheet S, and a support member 7 that supports the recording sheet S that faces the head unit 101. In addition, in this embodiment, a transporting direction of the recording sheet S is set as an X direction. In addition, with regard to a liquid ejecting surface of the head unit 101 which is provided with a nozzle opening, a direction perpendicular to the X direction is set as a Y direction. In addition, a direction perpendicular to the X direction and the Y direction is set as a Z direction. In addition, with regard to the X direction, an upstream side to which the recording sheet S is transported is set to an X1 side, and a downstream side is set as an X2 side. With regard to the Y direction, one side is set as a Y1 side, and the other side is set as a Y2 side. With regard to the Z direction, a liquid ejecting direction side (recording sheet S side) is set as a Z1 side, and the opposite side is set as a Z2 side.

The head unit 101 includes the plurality of recording heads 100, and a head fixing substrate 102 that retains the plurality of recording heads 100.

The plurality of recording heads 100 are arranged in parallel in the Y direction intersecting the X direction that is a transporting direction, and are fixed to the head fixing substrate 102. In addition, in this embodiment, the plurality of recording heads 100 are arranged in parallel on a straight line in the Y direction. That is, the plurality of recording heads 100 are arranged not to deviate in the X direction. According to this, a width of the head unit 101 in the X direction can be made small, and thus it is possible to realize miniaturization of the head unit 101.

The head fixing substrate 102 retains the plurality of recording heads 100 in such a manner that nozzle openings of the plurality recording heads 100 face a recording sheet S side, and is fixed to the apparatus main body 2.

The transporting unit 4 transports the recording sheet S in the X direction toward the head unit 101. The transporting unit 4 includes a first transporting roller 5 and a second transporting roller 6 which are provided, for example, on both sides of the head unit 101 in the X direction that is a transporting direction of the recording sheet S. The recording sheet S is transported in the X direction by the first transporting roller 5 and the second transporting roller 6. In addition, the transporting unit 4 that transports the recording sheet S is not limited to transporting rollers, and a belt, a drum, and the like are also possible.

The support member 7 supports the recording sheet S, which is transported by the transporting unit 4, at a position that faces the head unit 101. For example, the support member 7 is formed from a metal, a resin, and the like which have a rectangular cross-sectional shape, and is provided between the first transporting roller 5 and the second transporting roller 6 to face the head unit 101.

In addition, the support member 7 may be provided with a suction unit configured to suction the recording sheet S, which is transported, on the support member 7. Examples of the suction unit include a unit that attracts the recording sheet S and suctions the recording sheet S in an attracting manner, a unit that suctions the recording sheet S with an electrostatic force in an electrostatic manner, and the like. In addition, for example, in a case where the transporting unit 4 is configured of a belt, a drum, and the like, the support member 7 supports the recording sheet S on the belt or the drum at a position that faces the head unit 101.

A liquid storage unit (not illustrated) such as an ink tank and an ink cartridge in which ink is stored is connected to each of the recording heads 100 of the head unit 101 in a manner capable of supplying the ink. For example, the liquid storage unit may be retained on the head unit 101, or at a position different from that of the head unit 101 inside the apparatus main body 2. In addition, a flow passage configured to supply the ink, which is supplied from the liquid storage unit, to the recording head 100, and the like may be provided inside the head fixing substrate 102. In addition, an ink flow passage member may be provided to the head fixing substrate 102, and the ink may be supplied to the recording head 100 from the liquid storage unit through the ink flow passage member. The ink may be directly supplied to the recording head 100 from the liquid storage unit without passing through the head fixing substrate 102, the ink flow passage member that is fixed to the head fixing substrate 102, and the like.

In the ink jet type recording apparatus 1, the recording sheet S is transported in the X direction by the first transporting roller 5, and printing is performed with respect to the recording sheet S, which is supported on the support member 7, by the head unit 101. The recording sheet S that is printed out is transported in the X direction by the second transporting roller 6.

Figure 2:
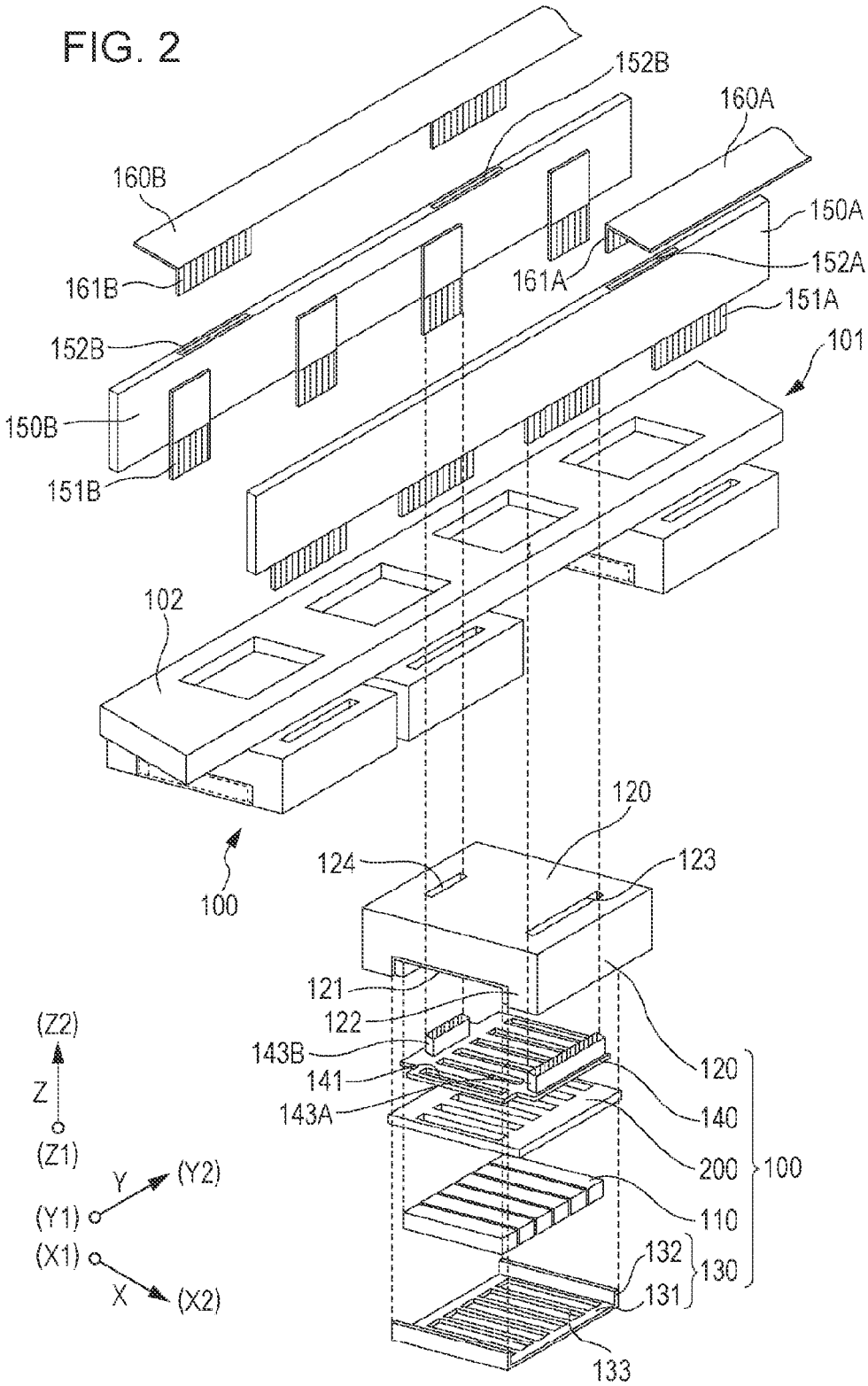
FIG. 2 is an exploded perspective view of a head unit according to the first embodiment of the invention.

The head unit 101 will be described in detail with reference to FIG. 2. FIG. 2 is an exploded perspective view illustrating the head unit according to this embodiment.

The head unit 101 according to this embodiment includes the plurality of recording heads 100, and the head fixing substrate 102 that retains the plurality of recording heads 100. Each of the recording heads 100 has a liquid ejecting surface 20*a*, which is provided with nozzle openings 21, on a Z1 side in the Z direction. Each of the recording heads 100 is fixed to the head fixing substrate 102 on a surface side that faces the recording sheet S, that is, on the Z1 side that is a recording sheet S side in the Z direction.

As described above, the plurality of recording heads 100 are arranged in parallel on a straight line in the Y direction perpendicular to the X direction that is the transporting direction, and are fixed to the head fixing substrate 102. That is, the plurality of recording heads 100 are arranged not to deviate in the X direction. According to this, a width of the head unit 101 in the X direction can be made small, and thus it is possible to realize miniaturization of the head unit 101. In addition, the recording heads 100, which are arranged in parallel in the Y direction, may be arranged to deviate in the X direction. However, when the recording heads 100 greatly deviate in the X direction, a width of the head fixing substrate 102, and the like in the X direction is apt to increase. In this manner, when the size of the head unit 101 in the X direction increases, a distance between the first transporting roller 5 and the second transporting roller 6 in the ink jet type recording apparatus 1 in the X direction increases, and thus posture fixing of the recording sheet S may be difficult. In addition, the size of the head unit 101 and the ink jet type recording apparatus 1 is apt to increase.

In addition, in this embodiment, four recording heads 100 are fixed to the head fixing substrate 102, but the number of the recording heads 100 is not particularly limited as long as the number of the recording heads 100 is two or greater.

Figure 3:
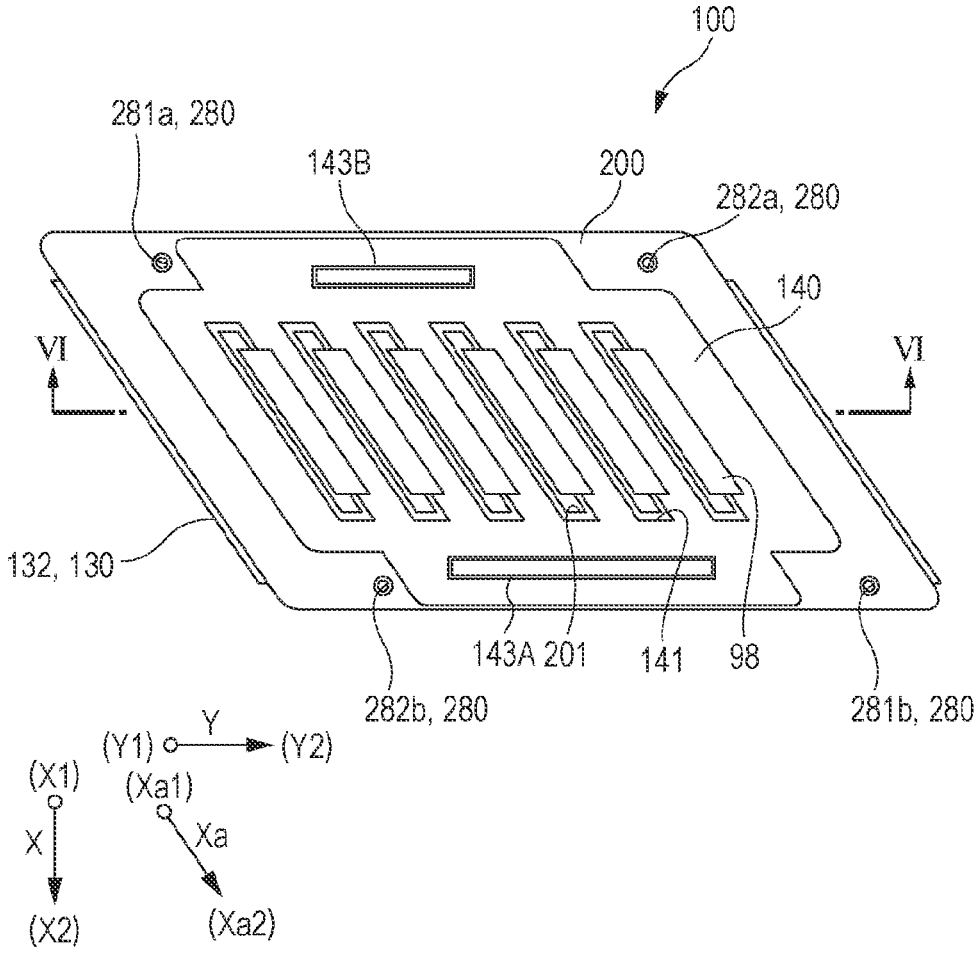
FIG. 3 is a plan view of the recording head according to the first embodiment of the invention.
Figure 4:
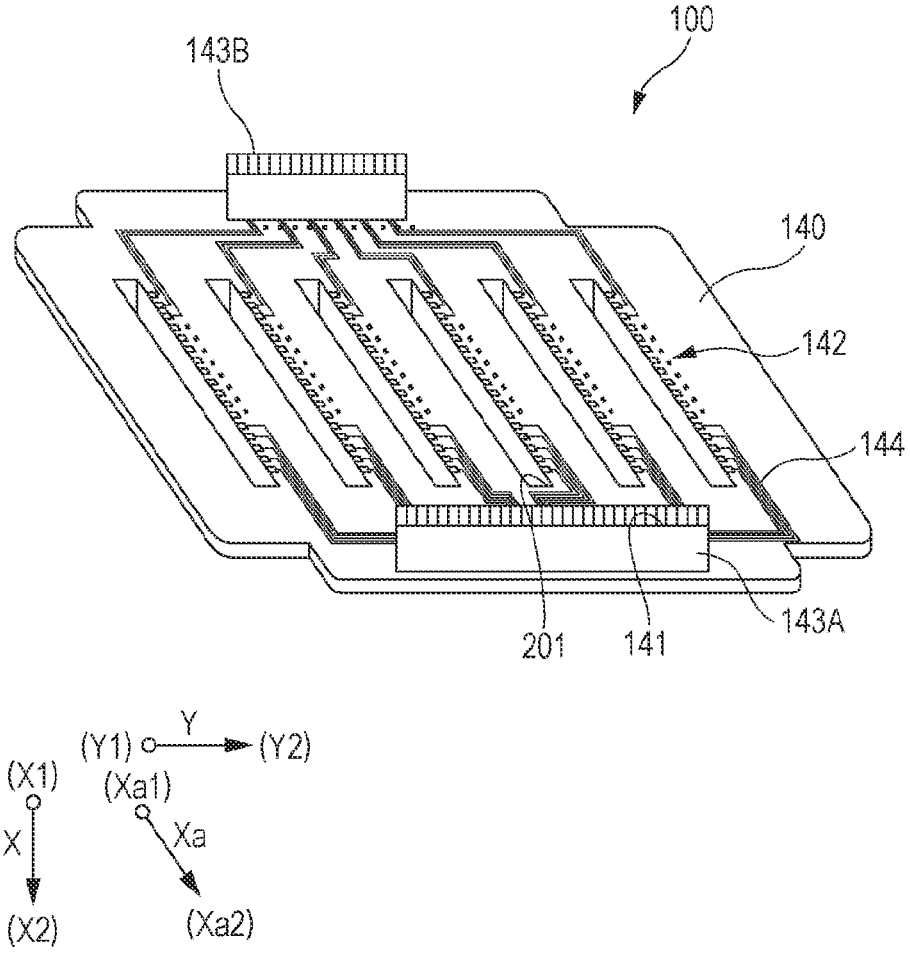
FIG. 4 is a perspective view of an interconnection substrate according to the first embodiment.
Figure 5:
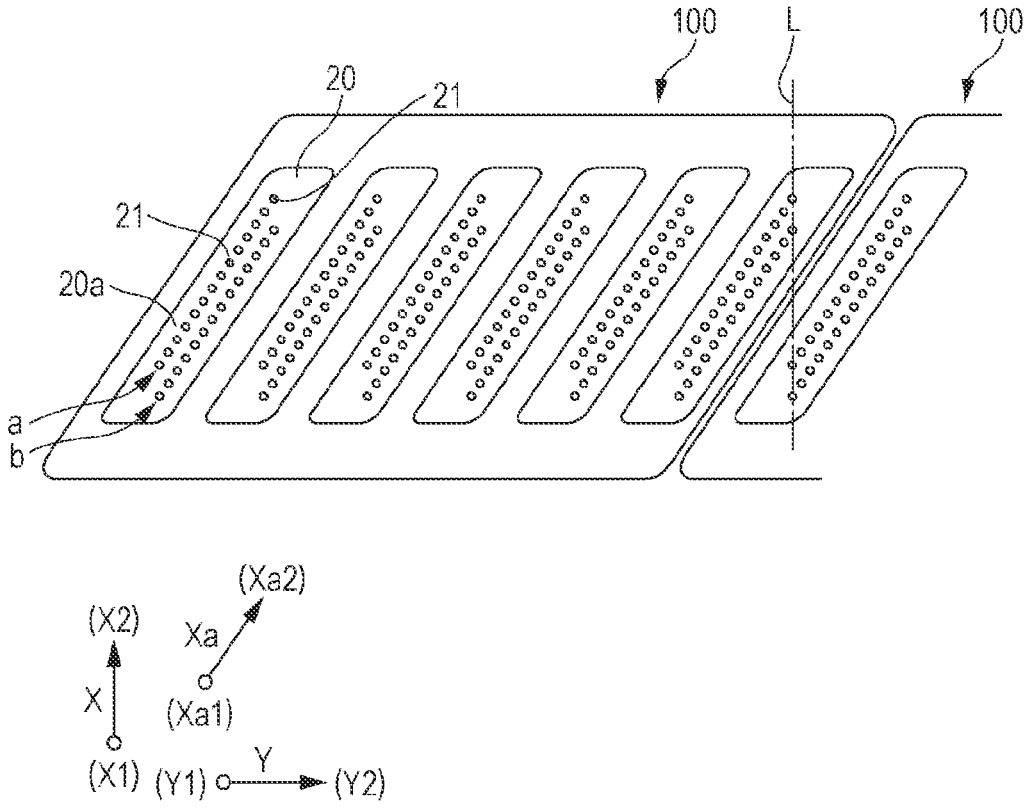
FIG. 5 is a bottom view of the recording head according to the first embodiment of the invention.
Figure 6:
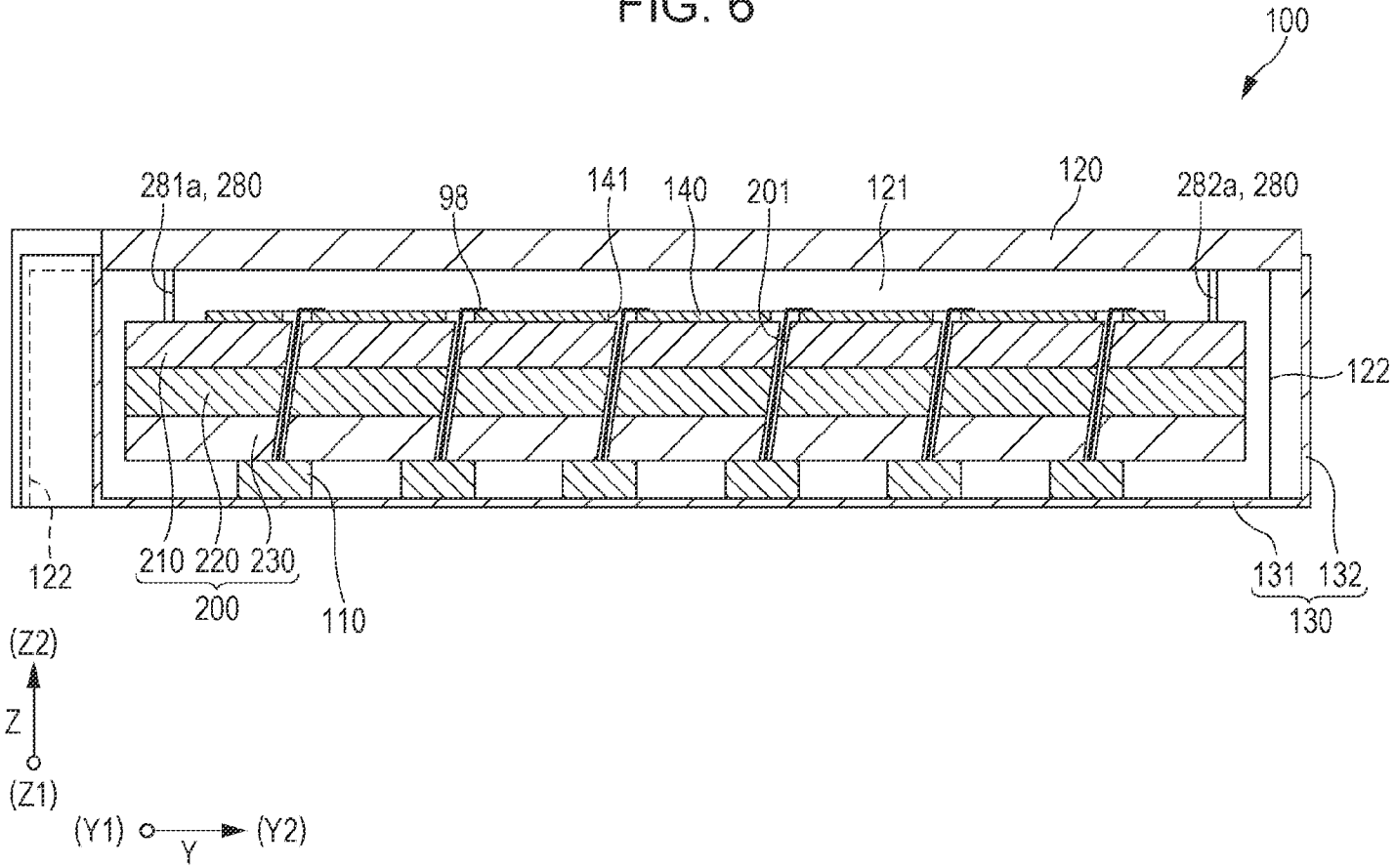
FIG. 6 is a cross-sectional view taken along line VI-VI in FIG. 3.

Each of the recording heads 100 will be described with reference to FIGS. 2 to 6. FIG. 3 is a plan view of the recording head, FIG. 4 is a perspective view of an interconnection substrate, FIG. 5 is a bottom view of the recording head, and FIG. 6 is a cross-sectional view taken along line VI-VI in FIG. 3. In addition, FIG. 3 is a plan view of the recording head 100 on a Z2 side in the Z direction, and a retention member 120 is not illustrated.

The recording head 100 includes a plurality of head main bodies 110, a COF substrate 98 that is connected to each of the head main bodies 110, and a flow passage member 200 provided with a flow passage configured to supply ink to each of the head main bodies 110. In addition, in this embodiment, the recording head 100 includes a retention member 120 that retains the plurality of head main bodies 110, a fixing plate 130 that is provided on a liquid ejecting surface 20*a* side of the head main body 110, and an interconnection substrate 140.

The head main body 110 has a configuration in which ink is supplied from the retention member 120 provided with an ink flow passage, and the flow passage member 200, a control signal is transmitted from a control unit (not illustrated) provided to the ink jet type recording apparatus 1 through the interconnection substrate 140 and the COF substrate 98, and ink droplets are ejected on the basis of the control signal. Details of each of the head main bodies 110 will be described later.

Each of the head main bodies 110 has the liquid ejecting surface 20*a* provided with the nozzle openings 21 on a Z1 side in the Z direction. In addition, a Z2 side of the plurality of head main bodies 110 is bonded to a surface on a Z1 side of the flow passage member 200.

The flow passage member 200 is a member provided with a liquid flow passage of the ink that is supplied to the head main body 110. Although details of the flow passage member 200 will be described later, the plurality of head main bodies 110 are arranged in parallel in the Y direction and are bonded to the surface on the Z1 side of the flow passage member 200. In addition, the liquid flow passage provided to the flow passage member 200 communicates with the liquid flow passage of each of the head main bodies 110, and thus ink is supplied to each of the head main bodies 110 from the flow passage member 200.

In this embodiment, six head main bodies 110 are bonded to one flow passage member 200. The number of the head main bodies 110 which are fixed to the one flow passage member 200 is not limited thereto, and one head main body 110 or two or more head main bodies 110 may be fixed to the one flow passage member 200.

In addition, an opening 201 is provided to the flow passage member 200 so as to pass therethrough in the Z direction, and the COF substrate 98, of which one end is connected to the head main body 110, is inserted into the opening 201 so as to pass therethrough.

The COF substrate 98 is an example of a flexible interconnection substrate. The flexible interconnection substrate has a configuration in which an interconnection is formed on a flexible substrate. In addition, the COF substrate 98 includes a drive circuit 97 (refer to FIG. 7) that drives a pressure generating unit that is provided to the head main body 110.

The COF substrate 98, which is connected to the pressure generating unit that is an actuator of the head main body 110 that is an actuator unit, includes a connection terminal row 99 (refer to FIG. 16) on a side opposite to a connection end connected to the head main body 110, is inserted into the opening 201 and a through-hole portion 141 so as to pass therethrough, and is connected to a terminal row 142 that is provided on a surface on a Z2 side of an edge portion of the through-hole portion 141 of the interconnection substrate 140. That is, the COF substrate 98 is connected to each of the head main bodies 110 sheet by sheet, extends from a Z1 side to a Z2 side in the Z direction, and includes the connection terminal row 99, which is configured to supply a signal to each of the head main bodies 110, on an end. In addition, the COF substrates 98, which are connected to the plurality of head main bodies 110, respectively, are provided at positions overlapping each other when viewed in the Y direction. In addition, as described later, the COF substrate 98 according to this embodiment is provided in an inclined manner. However, a lead electrode 90 and the interconnection substrate 140, which are electrically connected to the COF substrate 98, are spaced away from each other in the Z direction, and thus it is assumed that the COF substrate 98 extends in the Z direction so as to include the case of the lead electrode 90 and the interconnection substrate 140.

As illustrated in FIG. 4, the interconnection substrate 140 is a substrate in which electrical components such as an interconnection, an IC, and a resistor are mounted on a surface thereof, and is disposed between the retention member 120 and the flow passage member 200. The through-hole portion 141, which communicates with the opening 201 provided to the flow passage member 200, is formed in the interconnection substrate 140. An opening shape of each through-hole portion 141 is formed to be larger than the opening 201 of the flow passage member 200, and a longitudinal direction thereof exists over an Xa direction that is inclined from the X direction corresponding to a first direction that is the transporting direction. In addition, the terminal row 142, to which a connection terminal row 99 of the COF substrate 98 to be described later is connected, is provided to an edge portion on one side in a width direction of the through-hole portion 141 which intersects a longitudinal direction thereof. The terminal row 142 is provided in six rows in correspondence with six through-hole portions 141, and the six terminal rows 142 are arranged in parallel in the Y direction perpendicular to the transporting direction.

The connection terminal row 99 of the COF substrate 98 is connected to each of the six terminal rows 142. As a result, the terminal rows 142 of the six COF substrates 98 are arranged along the Xa direction inclined from the X direction corresponding to the first direction that is the transporting direction, and are arranged in parallel in the Y direction perpendicular to the transporting direction.

On the other hand, a drive system connection connector 143A that serves as a drive system external connection terminal row, and a control system external connection connector 143B that serves as a control system external connection terminal row are provided on both ends of the interconnection substrate 140 in the X direction, respectively. The six terminal rows 142, and the drive system connection connector 143A and the control system external connection connector 143B are connected by interconnections 144. In addition, connection to the drive system connection connector 143A and the control system external connection connector 143B is performed through through-hole portions 123 and 124 which are provided to the retention member 120.

Here, although details will be described later, six sheets of the COF substrates 98, which are connected to six head main bodies 110, are connected to one interconnection substrate 140, signals, which are supplied to the six head main bodies 110, are collectively separated into drive system signals and control system signals, the interconnections 144 relating to the drive system signals are connected to the drive system connection connector 143A from the six terminal rows 142, and the interconnections 144 relating to the control system signals are connected to the control system external connection connector 143B from the six terminal rows 142.

The drive system signals are signals configured to actually drive a pressure generating unit that is a drive element, and are COM signals relating to Vbs that is a reference voltage, or a drive waveform. In drive system signal, a voltage is relatively high, and a large current is necessary. On the other hand, the control system signals are signals configured to control a drive circuit 97 that is a semiconductor device configured to control a drive element, and is used for a case of a relatively constant voltage and a low current. Accordingly, the drive system connection connector 143A may use a connector with a large pitch, and the control system external connection connector 143B may use a connector with a relatively small pitch. That is, in a case where the six head main bodies 110 are divided in half, and signals to be supplied for each divided part (three head main bodies) are supplied by using one connection connector, the drive system signals and the control system signals are mixed in, and thus it is necessary to use a connection connector with a large pitch. However, in this case, the size of the connection connector increases in comparison to a case where the drive system signals and the control system signals are separated from each other as described above, and thus it is difficult to arrange the connection connectors in a defined space. However, as described above, when the drive system signals and the control system signals are separated from each other and are supplied, it is possible to arrange the connection connectors in a defined space. However, in a case where a spatial margin is secured, for example, the connection connectors may be provided for each of the head main bodies 110 or for a plurality of the head main bodies 110 without limitation thereto.

Here, as described above, the drive system connection connector 143A and the control system external connection connector 143B are disposed on an outer side in the first direction, respectively. In addition, although details will be described later, on both sides each of the drive system connection connector 143A and the control system external connection connector 143B in a second direction, liquid flow passages of the flow passage member 200 that supplies a liquid to the head main bodies 110 that are actuator units, that is, second introduction flow passages 282*a* and 282*b*, and first introduction flow passages 281*a* and 281*b* are arranged. Specifically, the drive system connection connector 143A is disposed between the second introduction flow passage 282*a* and the second introduction flow passage 282*b* in the second direction, and the control system external connection connector 143B is disposed between the first introduction flow passage 281*a* and the first introduction flow passage 281*b* in the second direction.

As illustrated in FIG. 2, the interconnection substrate 140 is connected to a control unit of the ink jet type recording apparatus 1. Specifically, connection terminals 151A of a relay substrate 150A are configured to be connected to four drive system connection connectors 143A, and connection terminals 151B of a relay substrate 150B are configured to be connected to four control system external connection connectors 143B. In addition, the relay substrate 150A is provided with one connector 152A that supplies drive system signals from the outside, and the relay substrate 150B is provided with two connectors 152B that supply control system signals from the outside. Connection terminals 161A of a flexible printed substrate, that is, an FPC substrate 160A, which supply the drive system signals from the outside, are connected to the connector 152A of the relay substrate 150A. In addition, connection terminals 161B of an FPC substrate 160B, which supply the control system signals from the outside, are connected to the connector 152B of the relay substrate 150B.

According to this, the drive signals and the control signals, which are transmitted from the control unit of the ink jet type recording apparatus 1, enter the drive system connection connector 143A and the control system external connection connector 143B of the interconnection substrate 140 through the FPC substrates 160A and 160B, and the relay substrates 150A and 150B, and are transmitted to the drive circuit 97 of the COF substrate 98 to allow the drive circuit 97 to drive the pressure generating unit of the head main bodies 110. According to this, an ink ejecting operation of the recording head 100 is controlled.

The retention member 120 includes a retention portion 121 that forms a groove-shaped space in the Z1 side. The retention portion 121 is continuously provided in a surface on a Z1 side of the retention member 120 along the Y direction, and thus the retention portion 121 is provided to be opened from both side surfaces in the Y direction. In addition, the retention member 120 is provided at approximately the center of the retention portion 121 in the X direction, and a leg portion 122 is formed on both sides of the retention portion 121 in the X direction. That is, the leg portion 122 is provided to the surface on the Z1 side of the retention member 120 only on both ends in the X direction, and is not provided on both ends in the Y direction. In addition, in this embodiment, the retention member 120 is constituted by one member. However, there is no limitation to this aspect, and the retention member 120 may be constructed by laminating a plurality of members in the Z direction.

The interconnection substrate 140, the flow passage member 200, and the plurality of head main bodies 110 are accommodated in the retention portion 121. Specifically, each of the head main bodies 110 is bonded to a surface on a Z1 side of the flow passage member 200 with an adhesive and the like, and the interconnection substrate 140 is fixed to a surface on a Z2 side of the flow passage member 200. The interconnection substrate 140, the flow passage member 200, and the plurality of head main bodies 110, which are integrally formed as described above, are accommodated in the retention portion 121.

With regard to bonding between the retention member 120 and the flow passage member 200, surfaces of the retention portion 121 and the flow passage member 200, which face each other in the Z direction, are bonded with an adhesive. The interconnection substrate 140 is accommodated in a space between the retention portion 121 and the flow passage member 200. In addition, the retention member 120 and the flow passage member 200 may be integrated with a fixing unit such as a screw instead of the bonding with an adhesive.

In addition, although not particularly illustrated, a flow passage through which ink flows, a filter that traps foreign matter and the like, and the like are formed in the retention member 120. The flow passage of the retention member 120 communicates with the liquid flow passage of the flow passage member 200. According to this, ink is supplied to the head main body 110 through the retention member 120 and the flow passage member 200 from the liquid storage unit provided to the ink jet type recording apparatus 1.

The fixing plate 130 is a member that is provided on the liquid ejecting surface 20*a* side of the recording head 100, that is, on the Z1 side of the recording head 100 in the Z direction to retain the recording head 100. For example, the fixing plate 130 is formed by bending a plate-shaped member such as a metal. Specifically, the fixing plate 130 includes a base portion 131 that is provided on the liquid ejecting surface 20*a* side, and a bent portion 132 that is provided by bending both ends of the base portion 131 in the Y direction toward the Z2 side in the Z direction.

In addition, an exposure opening 133, which is an opening to expose the nozzle openings 21 of each of the head main bodies 110, is provided in the base portion 131. In this embodiment, the exposure opening 133 is provided to be independently opened for each of the head main bodies 110. That is, the recording head 100 of this embodiment includes six head main bodies 110, and thus six independent exposure openings 133 are provided in the base portion 131. In addition, one exposure opening 133, which is common to a head main body group constituted by a plurality of the head main bodies 110, may be provided in accordance with the configuration of the head main bodies 110.

The Z1 side of the retention portion 121 of the retention member 120 is covered with the base portion 131. As illustrated in FIG. 6, the base portion 131 is bonded to a surface on a Z1 side of the retention member 120 in the Z direction, that is, end surfaces a Z1 side of the leg portions 122 through an adhesive.

In addition, the bent portion 132 is provided on both ends of the base portion 131 in the Y direction, and is formed with a size for covering an opening area that is opened toward a side surface of the retention portion 121 in the Y direction. That is, the bent portion 132 is a region ranging from an end of the base portion 131 in the Y direction to an edge of the fixing plate 130. In addition, the bent portion 132 is bonded to a side surface of the retention member 120 in the Y direction through an adhesive. According to this, the opening in the side surface of the retention portion 121 in the Y direction is covered with the bent portion 132 and is sealed.

As described above, the fixing plate 130 is bonded to the retention member 120 with an adhesive, and thus the head main bodies 110 are accommodated inside the retention portion 121 that is a space between the retention member 120 and the fixing plate 130.

As described above, in the recording head 100 according to this embodiment, the plurality of head main bodies 110 are provided to one recording head 100 to realize multiple nozzle rows. Accordingly, it is possible to improve a yield rate in comparison to a case where a plurality of nozzle rows are provided to only one head main body 110 with respect to one recording head 100 to realize multiple rows. That is, when the multiple nozzle rows are realized in a single head main body 110, the yield rate of the head main body 110 decreases, and the manufacturing cost increases. In contrast, the multiple nozzle rows are realized by the plurality of head main bodies 110, the yield rate of the head main bodies 110 is improved, and thus it is possible to reduce the manufacturing cost.

In addition, the opening in the side surface of the retention member 120 in the Y direction is sealed by the bent portion 132 of the fixing plate 130. According to this, even when a leg portion for bonding with the base portion 131 of the fixing plate 130 is not provided on both sides of the retention member 120 in the Y direction, it is possible to suppress evaporation of moisture from the opening provided on the side surface of the retention portion 121 in the Y direction.

Accordingly, in the head unit 101 in which the plurality of recording heads 100 are arranged in parallel in the Y direction, the leg portion 122 is not provided at the side of the recording heads 100 adjacent to each other in the Y direction, and thus it is possible to make the spacing between the recording heads 100 adjacent in the Y direction small. Accordingly, it is possible to provide the head main bodies 110 of the recording heads 100, which are adjacent to each other in the Y direction, to be close to each other, and thus it is possible to allow the nozzle openings 21, which are provided in each of the head main bodies 110 of the recording heads 100 adjacent to each other, to be close to each other in the Y direction.

In addition, in the recording head 100 according to this embodiment, the leg portion 122 is provided on both sides of the retention member 120 in the X direction, but the leg portion 122 may not be provided. That is, the head main bodies 110 may be configured to be bonded to the surface on the Z1 side of the retention member 120, and the bent portion 132 may be provided on both sides of the fixing plate 130 in the X direction and the Y direction. That is, the bent portion 132 may be provided to the fixing plate 130 over the entire periphery thereof in an in-plane direction of the liquid ejecting surface 20*a*, and the fixing plate 130 may be bonded to the entire periphery of the side surfaces of the retention member 120. However, as is the case with this embodiment, when the leg portion 122 is provided on both sides of the retention member 120 in the X direction, and an end surface on the Z1 side of the leg portion 122 is bonded to the base portion 131 of the fixing plate 130, it is possible to improve the strength of the ink jet type recording head 100 in the Z direction, and it is possible to suppress evaporation of moisture from the leg portion 122.

Figure 7:
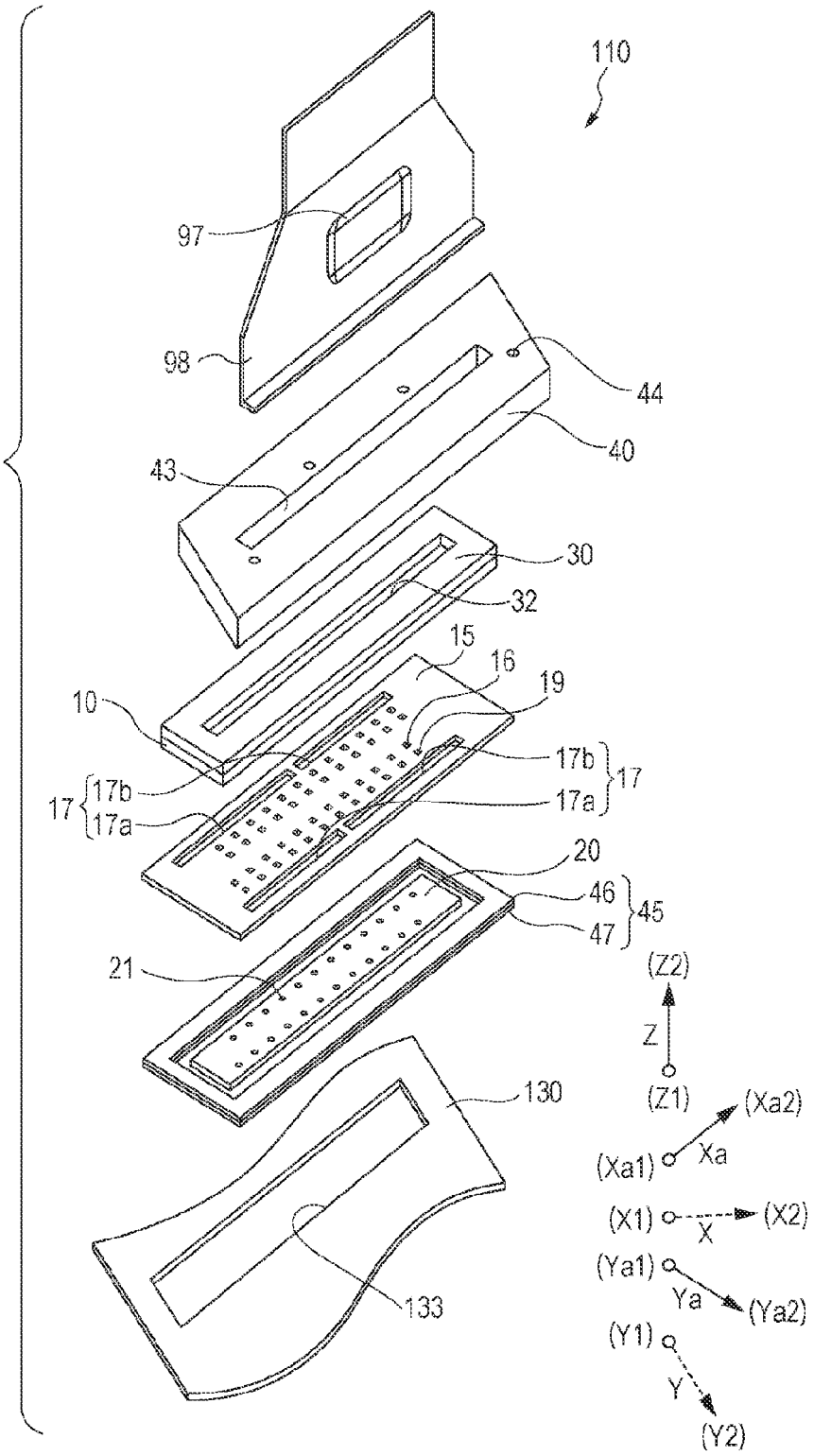
FIG. 7 is an exploded perspective view of a head main body according to the first embodiment of the invention.
Figure 8:
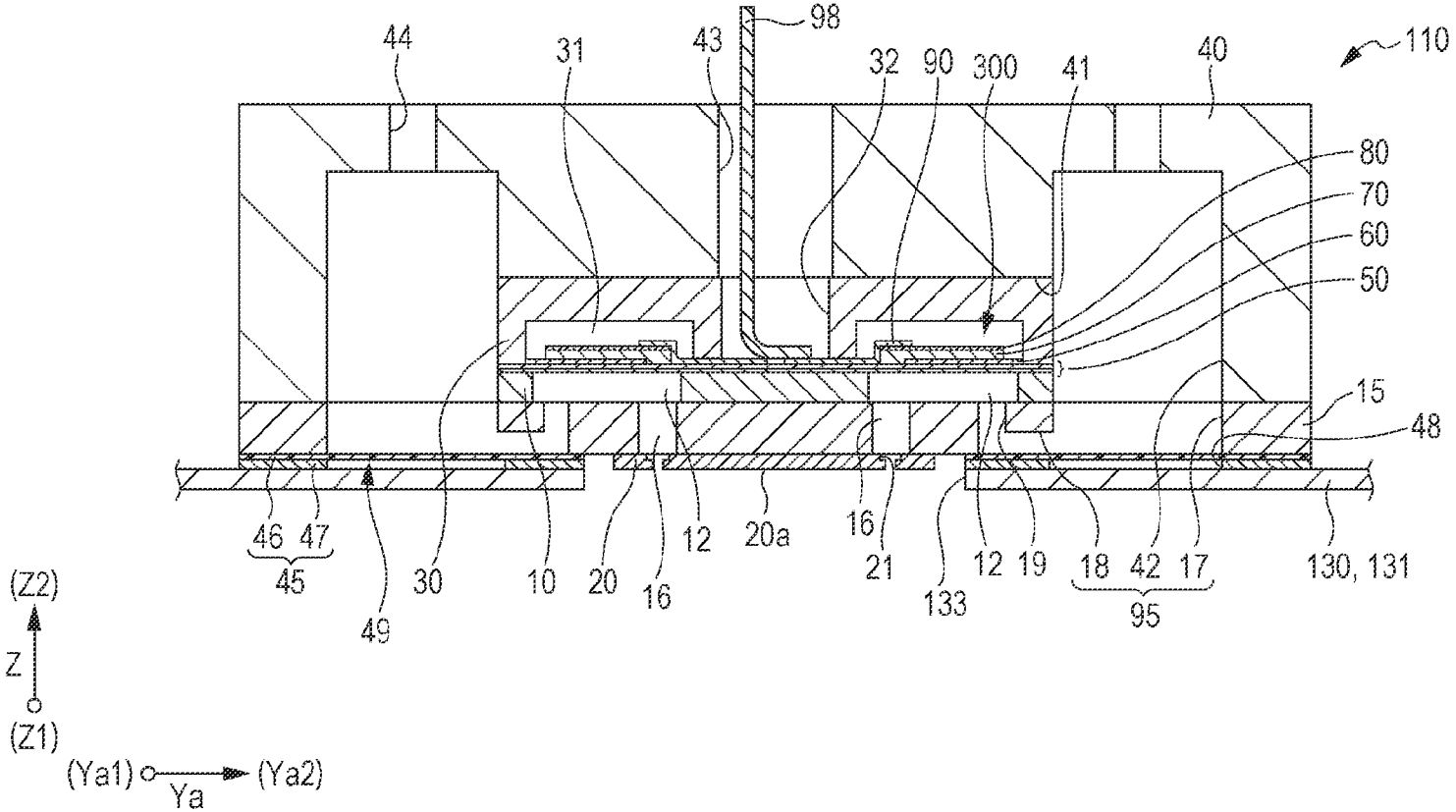
FIG. 8 is a cross-sectional view of the head main body according to the first embodiment of the invention.

The head main bodies 110 will be described with reference to FIGS. 7 and 8. FIG. 7 is a perspective view of each of the head main bodies according to this embodiment, and FIG. 8 is a cross-sectional view of the head main body in the Y direction. It should be understood that the configuration of the head main body 110 is not limited to the following configuration.

The head main body 110 of this embodiment includes a pressure generating chamber 12, nozzle openings 21, a manifold 95, a pressure generating unit, and the like. For this configuration, a plurality of members such as a flow passage formed substrate 10, a communication plate 15, a nozzle plate 20, a protective substrate 30, a compliance substrate 45, and a case 40 are bonded to each other with an adhesive and the like.

In the flow passage formed substrate 10, pressure generating chambers 12, which are partitioned by a plurality of partition walls due to anisotropic etching from one surface side, are arranged along a parallel arrangement direction of the plurality of nozzle openings 21. In addition, in this embodiment, the parallel arrangement direction of the pressure generating chambers 12 is referred to as an Xa direction. In addition, a plurality of rows, in which the pressure generating chambers 12 are arranged in parallel in the Xa direction, are provided in the flow passage formed substrate 10, and in this embodiment, two rows are formed. Hereinafter, a row arrangement direction in which a plurality of rows of the row of the pressure generating chambers 12 are provided is referred to as a Ya direction. In addition, in this embodiment, a direction which is perpendicular to the Xa direction and the Ya direction is equal to the Z direction. In addition, the head main body 110 of this embodiment is mounted on the head unit 101 in such a manner that the Xa direction that is the parallel arrangement direction of the nozzle openings 21 is inclined to the X direction that is the transporting direction of the recording sheet S.

In addition, a supply passage, which has an opening area narrower than that of the pressure generating chamber 12 and which applies flow passage resistance of ink flowing into the pressure generating chamber 12, and the like may be provided to the flow passage formed substrate 10 on one end side of the pressure generating chamber 12 in the Ya direction.

The communication plate 15 is bonded to one surface side of the flow passage formed substrate 10. In addition, the nozzle plate 20 provided with the plurality of nozzle openings 21, each of which communicates with the pressure generating chamber 12, is bonded to the communication plate 15. In this embodiment, a Z1 side of the nozzle plate 20 in the Z direction, in which the nozzle openings 21 are opened, becomes the liquid ejecting surface 20*a*.

A nozzle communication passage 16, which communicates with the pressure generating chamber 12 and the nozzle opening 21, is provided in the communication plate 15. The communication plate 15 has an area larger than that of the flow passage formed substrate 10, and the nozzle plate 20 has an area smaller than that of the flow passage formed substrate 10. As described above, the area of the nozzle plate 20 is made to be relatively small, and thus it is possible to realize a reduction in the cost.

In addition, a first manifold 17 and a second manifold 18, which constitute parts of the manifold 95, are provided in the communication plate 15. The first manifold 17 is provided to pass through the communication plate 15 in the Z direction. The second manifold 18 does not pass through the communication plate 15 in the Z direction, is opened toward a nozzle plate 20 side of the communication plate 15, and is provided to a position partway through the thickness of the nozzle plate 20 in the Z direction.

In addition, in the communication plate 15, a supply communication passage 19, which communicates with one end of the pressure generating chamber 12 in the Y direction, is provided independently for each pressure generating chamber 12. The supply communication passage 19 communicates with the second manifold 18 and the pressure generating chamber 12.

The nozzle openings 21, each of which communicates with the pressure generating chamber 12 through the nozzle communication passage 16, are formed in the nozzle plate 20. The plurality of nozzle openings 21 are arranged in parallel in the Xa direction, the nozzle openings 21 which are arranged in parallel with each other constitute two nozzle rows a and b, and the nozzle rows a and b are arranged in parallel in the Ya direction. In addition, in this embodiment, although details will be described later, each of the nozzle rows a and b is divided into two parts so as to eject two kinds of liquids with one row, respectively.

On the other hand, a vibration plate 50 is formed on a surface side of the flow passage formed substrate 10 which is opposite to the communication plate 15. In addition, a first electrode 60, a piezoelectric layer 70, and a second electrode 80 are sequentially laminated on the vibration plate 50 to constitute a piezoelectric actuator 300 that is a pressure generating unit in this embodiment. In general, the piezoelectric actuator 300 is constructed by setting one electrode of the piezoelectric actuator 300 as a common electrode, and by performing patterning of the other electrode and the piezoelectric layer for each pressure generating chamber 12.

In addition, the protective substrate 30, which has approximately the same size as the flow passage formed substrate 10, is bonded to a surface on a piezoelectric actuator 300 side of the flow passage formed substrate 10. The protective substrate 30 includes a retention portion 31 that is a space for protecting the piezoelectric actuator 300. In addition, a through-hole 32 is formed in the protective substrate 30 to pass therethrough in the Z direction. An end of a lead electrode 90, which is led out from the electrode of the piezoelectric actuator 300, extends to be exposed in the through-hole 32, and the lead electrode 90 and the COF substrate 98 are electrically connected to each other in the through-hole 32.

In addition, a case 40, which defines the manifold 95 communicating with a plurality of the pressure generating chambers 12, is fixed to the protective substrate 30 and the communication plate 15. The case 40 has approximately the same shape as the above-described communication plate 15 in a plan view, and is bonded to the protective substrate 30 and the above-described communication plate 15. Specifically, the case 40 has a concave portion 41 with a depth for accommodation of the flow passage formed substrate and the protective substrate 30, on a protective substrate 30 side. The concave portion 41 has an opening area that is wider than that of a surface bonded to the flow passage formed substrate 10 of the protective substrate 30. In addition, an opening surface on a nozzle plate 20 side of the concave portion 41 is sealed by the communication plate 15 in a shape in which the flow passage formed substrate 10 and the like are accommodated in the concave portion 41. According to this, at an outer peripheral portion of the flow passage formed substrate 10, a third manifold 42 is defined by the case 40, the flow passage formed substrate 10, and the protective substrate 30. In addition, the manifold 95 of this embodiment is constituted by the third manifold 42, and the first manifold 17 and the second manifold 18 which are provided in the communication plate 15. In addition, as described above, two kinds of liquids can be ejected with one nozzle row, and thus the first manifold 17 the second manifold 18, and the third manifold 42, which constitutes the manifold 95, are divided into two parts, respectively, in a direction of the nozzle row, that is, in the Xa direction. For example, as illustrated in FIG. 7, the first manifold 17 includes first manifolds 17*a* and 17*b*. Similarly, the second manifold 18 and the third manifold 42 are divided into two parts, respectively, and thus the manifold 95 is divided into two parts as a whole in the Xa direction.

In this embodiment, the first manifolds 17, the second manifolds 18, and the third manifolds 42, which constitute a pair of the manifolds 95, are symmetrically arranged, respectively, with the nozzle row a and the nozzle row b interposed therebetween. According to this, it is possible to eject a different liquid for each of the nozzle row a and the nozzle row b. In addition, the arrangement of the manifolds is not limited thereto.

In addition, in this embodiment, the manifolds, which correspond to each nozzle row, are divided into two parts in the Xa direction, respectively, so as to eject four kinds of liquids as described later, and thus a total of four manifolds 95 are formed. One manifold may be formed for each of the nozzle rows a and b, or one manifold common to two nozzle rows a and b may be formed.

In addition, the compliance substrate 45 is provided to a surface of the communication plate 15 from which the first manifold 17 and the second manifold 18 are opened. The compliance substrate 45 seals openings of the first manifold 17 and the second manifold 18.

In this embodiment, the compliance substrate 45 includes a sealing film 46 and a fixing substrate 47. The sealing film 46 is formed from a flexible thin film (for example, polyphenylene sulfide (PPS) and stainless steel (SUS)) and the like. In addition, the fixing substrate 47 is formed from a hard material such as a metal including stainless steel (SUS). A region of the fixing substrate 47, which faces the manifold 95, is completely removed in the thickness direction and is configured of an opening 48. Accordingly, one surface of the manifold 95 is configured of the compliance portion 49 that is a flexible portion sealed with only the flexible sealing film 46.

In addition, the fixing plate 130 is bonded to the compliance substrate 45 on a surface opposite to the communication plate 15. That is, the exposure opening 133 provided in the base portion 131 of the fixing plate 130 has an opening area wider than the area of the nozzle plate 20, and from which the liquid ejecting surface 20*a* of the nozzle plate 20 is exposed in the exposure opening 133. The fixing plate 130 is not limited thereto. For example, the exposure opening 133 of the fixing plate 130 may be set to have an opening area that is smaller than the external shape of the nozzle plate 20, and the fixing plate 130 may be brought into contact with or bonded to the liquid ejecting surface 20*a* of the nozzle plate 20. In addition, even in a case where the exposure opening 133 of the fixing plate 130 is set to have an opening area that is smaller than the external shape of the nozzle plate 20, the fixing plate 130 and the liquid ejecting surface 20*a* may be provided not to come into contact with each other. That is, the configuration in which the fixing plate 130 is provided on a liquid ejecting surface 20*a* side also includes a configuration in which the fixing plate 130 comes into contact with the liquid ejecting surface 20*a* or the fixing plate 130 does not come into contact therewith.

In addition, an introduction passage 44, which communicates with the manifold 95 and supplies ink to each manifold 95, is provided to the case 40. In addition, a connection port 43, which communicates with the through-hole of the protective substrate 30 and into which the COF substrate 98 is inserted so as to pass therethrough, is provided to the case 40.

When ejecting ink, the head main body 110 configured as described above takes-in the ink from a storage unit through the introduction passage 44, and the inside of the flow passage is filled with the ink from the manifold 95 until the ink reaches the nozzle opening 21. Then, a voltage is applied to each piezoelectric actuator 300 corresponding to the pressure generating chamber 12 in accordance with a signal from the drive circuit 97 to deflect the piezoelectric actuator 300 and a vibration plate. According to this, pressure inside the pressure generating chamber 12 is raised, and thus an ink droplet is ejected from a predetermined nozzle opening 21.

Figure 9:
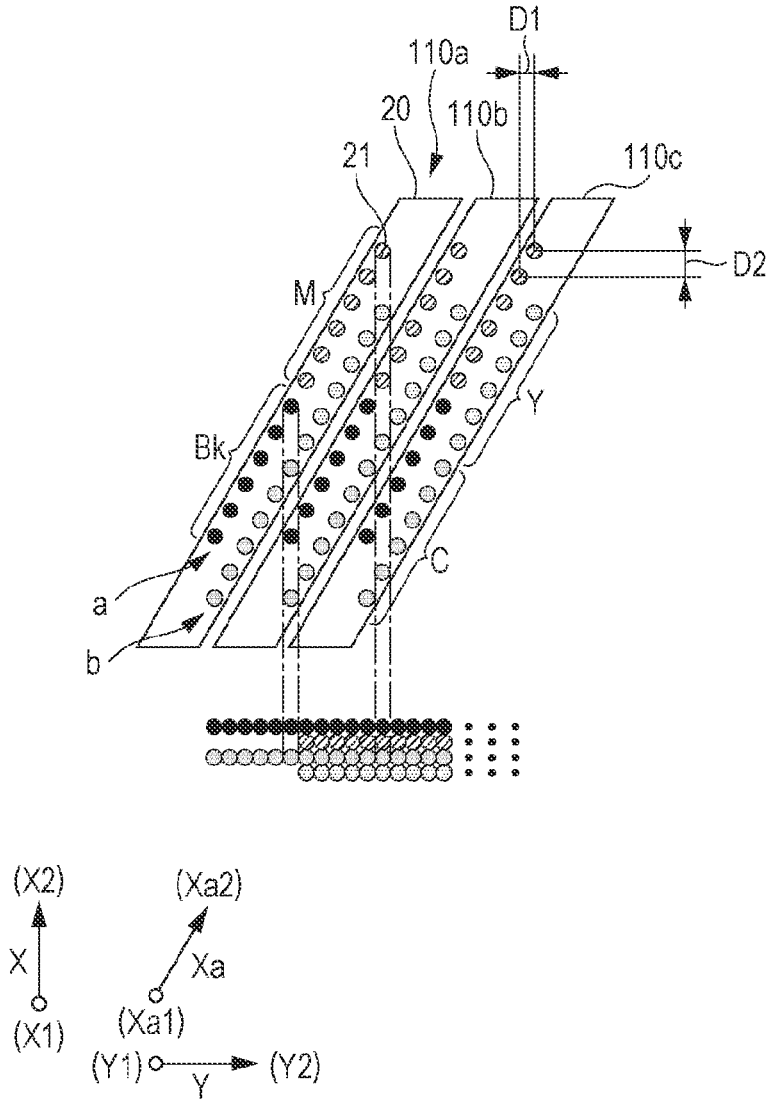
FIG. 9 is a view schematically illustrating an arrangement of nozzle openings of the first embodiment of the invention.

Here, detailed description will be given to a configuration in which the parallel arrangement direction of the nozzle openings 21 which constitute the nozzle row of the head main body 110 is inclined with respect to the X direction that is the transporting direction of the recording sheet S with reference to FIGS. 5 and 9. FIG. 9 is a view schematically illustrating arrangement of the nozzle openings of the head main body according to this embodiment.

The plurality of head main bodies 110 are fixed in such a manner that in an in-plane direction of the liquid ejecting surface 20*a*, the nozzle row a and the nozzle row b are inclined with respect to the X direction that is the transporting direction of the recording sheet S. The nozzle rows stated here represent nozzles in which the plurality of nozzle openings 21 are arranged in parallel in a predetermined direction. In this embodiment, the two nozzle rows a and b, in which the plurality of nozzles 21 are arranged in parallel in the Xa direction as a predetermined direction, are provided in the liquid ejecting surface 20*a* of the liquid ejecting surface 20*a*. The Xa direction intersects the X direction at an angle that is greater than 0° and less than 90°. Here, it is preferable that the X direction and the Xa direction intersect each other at an angle of greater than 0° and less than 45°. According to this configuration, it is possible to make a spacing D1 between nozzle openings 21 in the Y direction smaller in comparison to a case of intersection at an angle of greater than 45° and less than 90°, and thus it is possible to realize the recording head 100 with high resolution in the Y direction. The X direction and the Xa direction may intersect each other at an angle of greater than 45° and less than 90°.

In addition, the intersection between the X direction and the Xa direction at an angle of greater than 0° and less than 45° represents a state in which the nozzle rows are inclined toward the X direction in comparison to a straight line that interests the X direction at an angle of 45° in the surface of the liquid ejecting surface 20*a*. In addition, the spacing D1 stated here represents a spacing between the nozzle openings 21 in a case where the nozzle openings 21 of the nozzle row a and the nozzle row b are projected in the X direction with respect to a virtual line in the Y direction. In addition, a spacing between the nozzle openings 21 in a case where the nozzle openings 21 of the nozzle row a and the nozzle row b are projected in the Y direction with respect to a virtual line in the X direction is set to D2.

In addition, as illustrated in FIG. 9, in this embodiment, two kinds of liquid can be ejected with one nozzle rows and four kinds of liquids can be ejected with two nozzle rows. That is, when assuming that four colors of ink are used, for example, the nozzle row a is configured to eject black Bk and magenta M, and the nozzle row b is configured to eject cyan C and yellow Y. In addition, the nozzles a and b have the same number of nozzle openings 21, and the position of the nozzle openings 21 in the nozzle row a in the Y direction and the position of the nozzle openings 21 of the nozzle row b in the Y direction overlap each other in the X direction.

Head main bodies 110*a* to 110*c* have the same nozzle rows a and b, and the head main bodies 110*a* to 110*c* are provided to be close to each other in the Y direction. Accordingly, the respective nozzle openings 21 of the head main bodies 110, which are adjacent to each other in the Y direction, are arranged in parallel to overlap each other in the X direction. Accordingly, for example, when the nozzle row a of magenta M and the nozzle row b of yellow Y in the head main body 110*a* overlap the nozzle row a of black Bk and the nozzle row b of cyan C in the head main body 110*b* in the X direction, four colors are arranged in a line in the X direction, and thus a color image can be printed. In addition, with regard to the head main body 110*b* and the head main body 110*c* which are adjacent to each other in the Y direction, the respective nozzle openings 21 are also arranged in parallel to overlap each other in the X direction.

In addition, the nozzle openings 21 of at least parts of nozzle rows of the same color in the head main bodies 110 which are adjacent to each other are arranged to overlap each other in the X direction, and thus it is possible to improve an image quality of a joint between the head main bodies 110. That is, for example, one nozzle opening 21 of the nozzle row a of magenta M in the head main body 110*a* and one nozzle opening 21 of the nozzle row a of magenta M in the head main body 110*b* are arranged to overlap each other in the X direction. Accordingly, when ejection from the two nozzle openings 21 overlapping each other is controlled, it is possible to prevent deterioration in an image quality such as banding and a line at a joint between the head main bodies 110 which are adjacent to each other. In addition, in the example illustrated in FIG. 9, overlapping of only one nozzle opening 21 occurs in the X direction, but overlapping of two or more nozzle openings 21 may occur in the X direction.

The color arrangement is not limited to this. For example, although not particularly illustrated, arrangement may be made in such a manner that four colors of black Bk, magenta M, cyan C, and yellow Y can be ejected by one nozzle row.

As described above, four recording heads 100 including a plurality of the head main bodies 110 are fixed to the head fixing substrate 102 to construct the head unit 101. In this case, as indicated by a straight line L in FIG. 5, parts of nozzle rows of the recording heads 100 adjacent to each other are arranged to overlap each other in the X direction. That is, as is the case with the relationship between the head main bodies 110 adjacent to each other in one recording head 100, the head main bodies 110 adjacent to each other between the recording heads 100 adjacent to each other in the Y direction are provided to be close to each other in the Y direction. Accordingly, a color image can be printed between the recording heads 100 adjacent to each other, and it is possible to improve an image quality at a joint between the recording heads 100 adjacent to each other. In addition, it is not necessary for the number of nozzle openings 21, which overlap each other in the X direction between the recording heads 100 adjacent to each other, to be the same as the number of nozzle openings 21, which overlap each other in the X direction between the head main bodies 110 in one recording head 100.

As described above, when the nozzle rows between the head main bodies 110, and the nozzle rows between the recording heads 100 partially overlap each other in the X direction, it is possible to improve an image quality at a joint.

In addition, between the nozzle openings 21 of each nozzle row which are adjacent to each other in the Xa direction, it is preferable that a nozzle pitch or an angle between the X direction and the Xa direction is set in such a manner that the spacing D1 in the X direction and the spacing D2 in the Y direction establish an integer ratio. According to this configuration, in a case of printing image data constituted by pixels arranged in a matrix shape in the X direction and the Y direction, correspondence between each nozzle and each pixel becomes easy. In addition, there is no limitation to the integer ratio.

As illustrated in FIG. 5, the recording head 100 of this embodiment has an approximately parallelogram shape in a plan view from the liquid ejecting surface 20*a* side. This is because the Xa direction that is a parallel arrangement direction of the nozzle openings 21 that constitute the nozzle row a and the nozzle row b of each of the head main bodies 110 is inclined with respect to the X direction that is the transporting direction of the recording sheet S as described above, and the external shape of the recording head 100, that is, the fixing plate 130 is formed to have an approximately parallelogram shape similar to the Xa direction that is the inclination direction of the nozzle row a and the nozzle row b. The shape of the recording head 100 in a plan view from the liquid ejecting surface 20*a* side may be a trapezoidal rectangular shape, a polygonal shape, and the like without limitation to the approximately parallelogram shape.

In addition, the above-described embodiment, an example in which two nozzle rows are provided to one head main body has been described, but even in a case where three or more nozzle rows are provided to one head main body, it is needless to say that the above-described effect is also exhibited. In addition, as is the case with this embodiment, when two nozzle rows are provided to one head main body 110, it is possible to arrange the nozzle openings 21 of respective nozzle rows between two manifolds 95 corresponding to the respective nozzle rows as illustrated in FIG. 8. Accordingly, it is possible to make the spacing between the two nozzle rows in the Ya direction smaller in comparison to a case where the nozzle openings 21 of a plurality of nozzle rows are arranged on the same side as a manifold corresponding to the respective nozzle rows. As a result, it is possible to reduce an area necessary for one nozzle plate 20 with respect to two nozzle rows. In addition, connection between respective piezoelectric actuators 300 of the two nozzle rows and the COF substrate 98 also becomes easy.

In addition, in this embodiment, the respective nozzle rows a and b have the same number of nozzle openings 21. According to this configuration, the number of overlapping nozzle openings between respective nozzle rows in the X direction can be made equal in each case, and thus efficient liquid ejection can be performed. However, it is not necessary for the number of the nozzle openings to be equal in each nozzle row. In addition, the kinds of liquids which are ejected from the nozzle rows a and b may be the same as each other, for example, the same colors of ink may be used in all of the nozzle rows a and b.

In addition, in this embodiment, it is preferable that the head main body 110 has one nozzle plate 20 with respect to two nozzle rows. According to this configuration, arrangement of respective nozzle rows can be realized with higher accuracy. The nozzle plate 20 may be individually provided for each nozzle row. In addition, the nozzle plate is configured of stainless steel (SUS), a silicon substrate, and the like.

Figure 10:
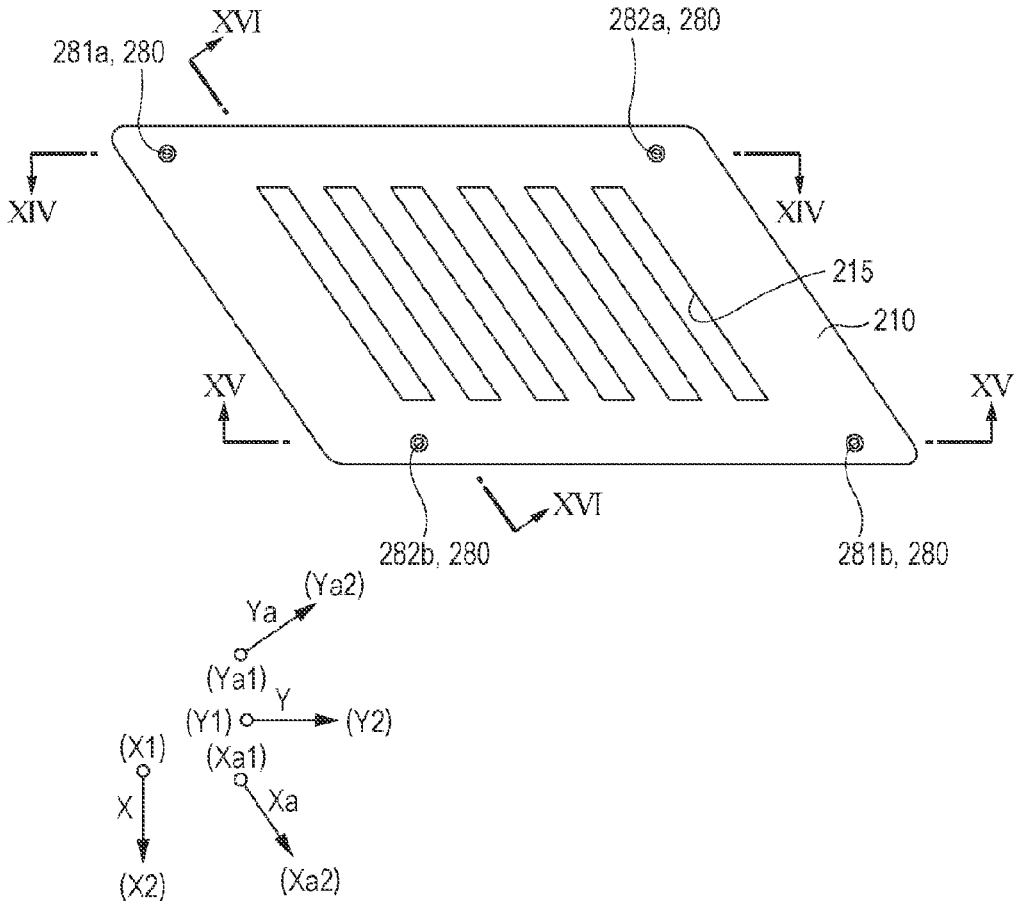
FIG. 10 is a plan view of a flow passage member (first flow passage member) according to the first embodiment of the invention.
Figure 11:
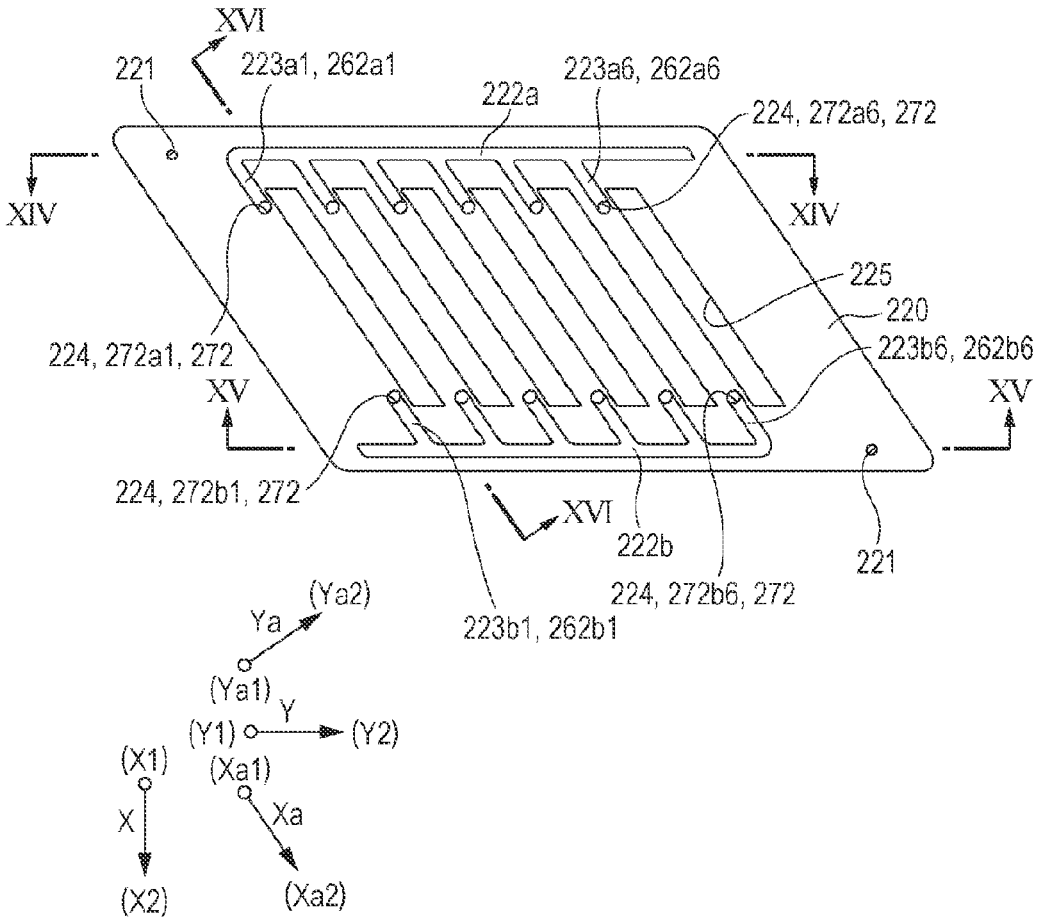
FIG. 11 is a plan view of a second flow passage member according to the first embodiment of the invention.
Figure 12:
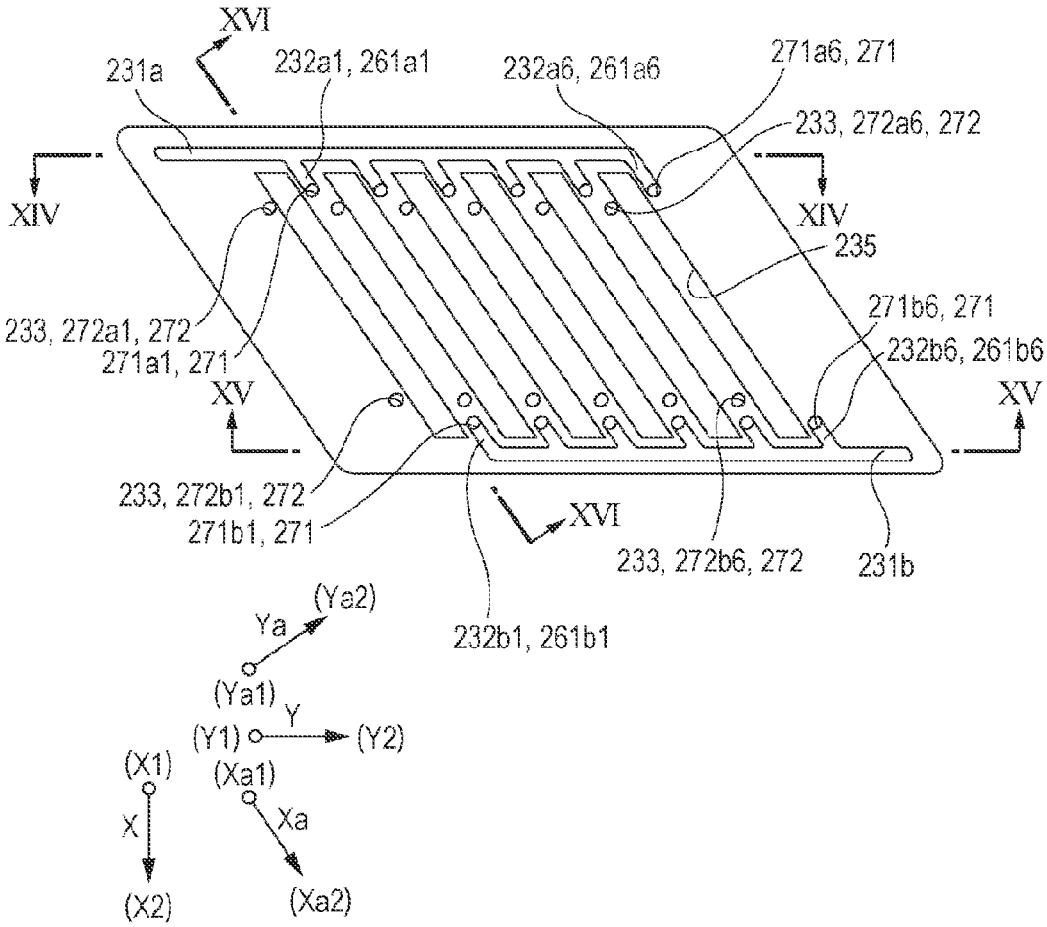
FIG. 12 is a plan view of a third flow passage member according to the first embodiment of the invention.
Figure 13:
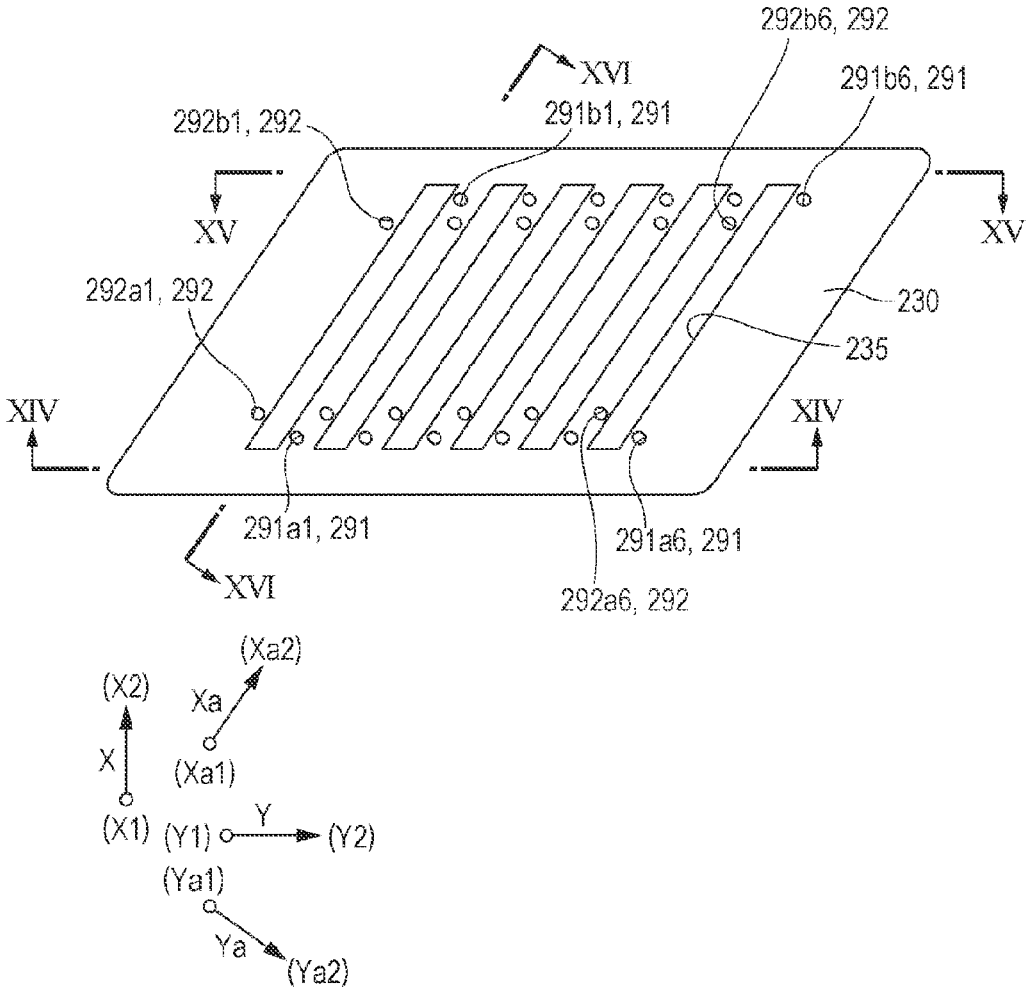
FIG. 13 is a bottom view of the third flow passage member according to the first embodiment of the invention.
Figure 14:
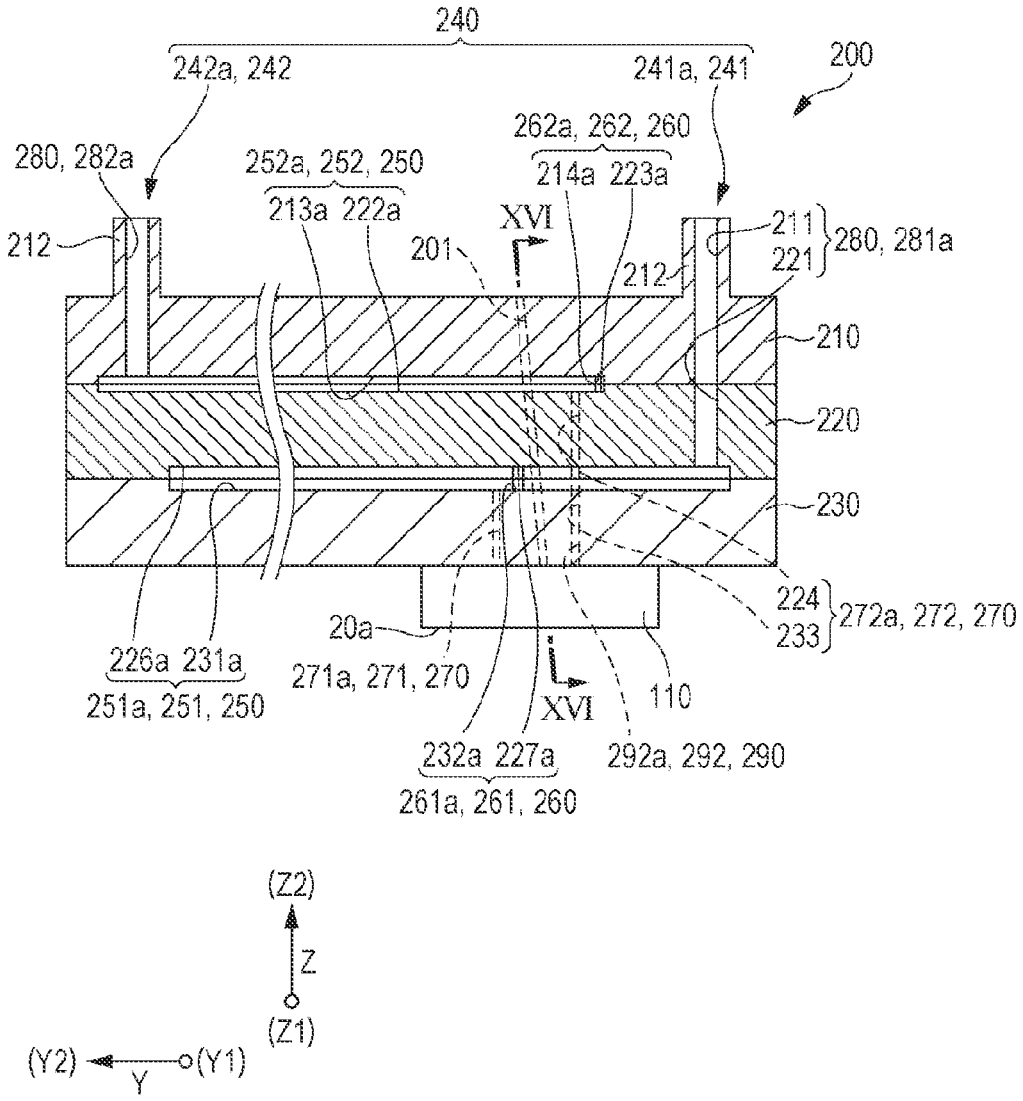
FIG. 14 is a cross-sectional view taken along line XIV-XIV in FIGS. 10 to 13.
Figure 15:
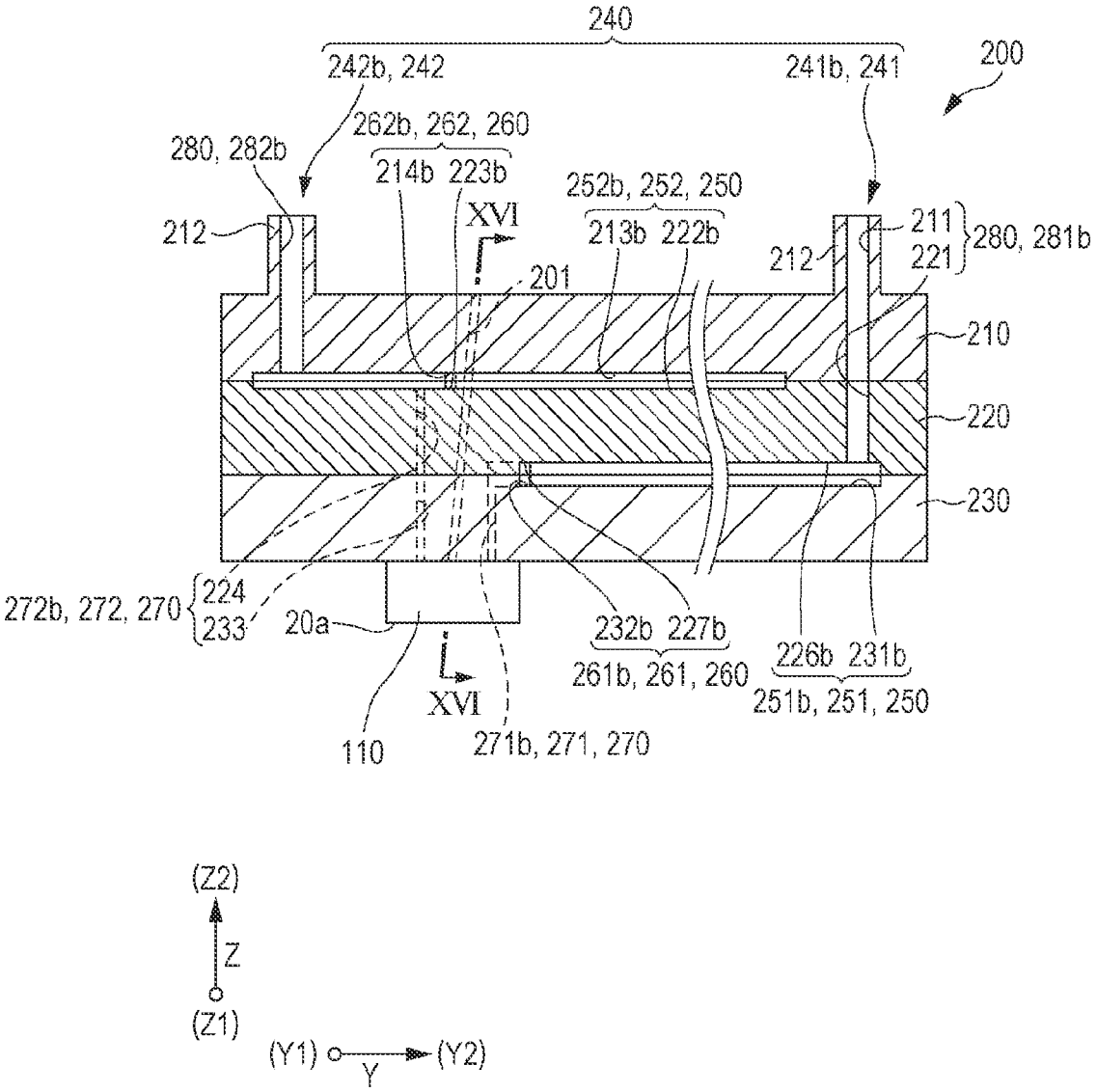
FIG. 15 is a cross-sectional view taken along line XV-XV in FIGS. 10 to 13.

The flow passage member 200 of this embodiment will be described in detail with reference to FIGS. 10 to 16. FIG. 10 is a plan view of a first flow passage member as the flow passage member 200, FIG. 11 is a plan view of a second flow passage member as the flow passage member 200, FIG. 12 is a plan view of a third flow passage member as the flow passage member 200, FIG. 13 is a bottom view of the third flow passage member, FIG. 14 is a cross-sectional view taken along line XIV-XIV in FIGS. 10 to 13, FIG. 15 is a cross-sectional view taken along line XV-XV in FIGS. 10 to 13, and FIG. 16 is a cross-sectional view taken along line XVI-XVI in FIGS. 10 to 15. In addition, FIGS. 10 to 12 are plan views on the Z2 side, and FIG. 13 is a bottom view on the Z1 side.

The flow passage member 200 is a member provided with a flow passage 240 through which ink flows. In this embodiment, a first flow passage member 210, a second flow passage member 220, and a third flow passage member 230 which are laminated in the Z direction, and a plurality of flow passage 240 are provided. In the Z direction, the first flow passage member 210, the second flow passage member 220, and the third flow passage member 230 are sequentially laminated from a retention member 120 side (refer to FIG. 6) toward a head main body 110 side. Although not particularly illustrated, the first flow passage member 210, the second flow passage member 220, and the third flow passage member 230 are fixed to each other with an adhesive. However, there is no limitation to this aspect, and for example, the first flow passage member 210, the second flow passage member 220, and the third flow passage member 230 may be integrated with a fixing unit such as a screw. In addition, a material is not particularly limited, and for example, the flow passage members may be formed from a metal such as SUS, or a resin.

The flow passage 240 is a flow passage including an introduction flow passage 280 into which ink supplied from an upstream member (in this embodiment, the retention member 120) is introduced, and a connection portion 290 as an outlet through which the ink is supplied to a head at both ends. In this embodiment, four flow passages 240 are formed, and each of the flow passages 240 has a configuration in which ink is supplied to one introduction flow passage 280, and which diverges midway, and the ink is supplied from a plurality of connection portions 290 to the head main body 110.

Parts of the four flow passages 240 are set as a first flow passage 241, and the others are set as a second flow passage 242. In this embodiment, the first flow passage 241 and the second flow passage 242 are formed in a number of two, respectively. The two first flow passages 241 are set as a first flow passage 241*a* and a first flow passage 241*b*. Hereinafter, when being described as the first flow passage 241, the description is intended to indicate both the first flow passage 241*a* and the first flow passage 241*b*. This is also true of the second flow passage 242.

The first flow passage 241 includes a first introduction flow passage 281. In the first flow passage 241, the first introduction flow passage 281 is a flow passage that connects a first distribution flow passage 251 to be described later, and a flow passage (in this embodiment, a flow passage of the retention member 120) located upstream of the flow passage member 200. In this embodiment, the two first flow passages 241*a* and 241*b* include a first introduction flow passage 281*a* and a first introduction flow passage 281*b*, respectively.

Specifically, the first introduction flow passage 281*a* has a configuration in which a through-hole 211, which is opened to the top surface of a protrusion 212 provided on a surface on a Z2 side of the first flow passage member 210 and passes through the protrusion 212 in the Z direction, and a through-hole 221 that passes through the second flow passage member 220 in the Z direction communicate with each other. This configuration is also true of the first introduction flow passage 281*b*. Hereinafter, when being described as the first introduction flow passage 281, the description is intended to indicate the first introduction flow passage 281*a* and the first introduction flow passage 281*b*.

The second flow passage 242 includes a second introduction flow passage 282. In the second flow passage 242, the second introduction flow passage 282 is a flow passage that connects a second distribution flow passage 252 to be described later, and a flow passage (in this embodiment, a flow passage of the retention member 120) located upstream of the flow passage member 200. In this embodiment, two second flow passages 242*a* and 242*b* include a second introduction flow passage 282*a* and a second introduction flow passage 282*b*, respectively.

Specifically, the second introduction flow passage 282*a* is a through-hole that is opened to the top surface of a protrusion 212 provided on the surface on the Z2 side of the first flow passage member 210 and passes through the protrusion 212 in the Z direction. This is also true of the second introduction flow passage 282*b*. Hereinafter, when being described as the second introduction flow passage 282, the description is intended to indicate the second introduction flow passage 282*a* and the second introduction flow passage 282*b*.

In addition, when being described as the introduction flow passage 280, the description is intended to indicate all of the above-described four introduction flow passages.

In this embodiment, in a plan view of FIG. 10, the first introduction flow passage 281*a* is arranged in the vicinity of an upper-left corner of the first flow passage member 210, and the first introduction flow passage 281*b* is arranged in the vicinity of a lower-right corner of the first flow passage member 210. In addition, in a plan view of FIG. 10, the second introduction flow passage 282*a* is arranged in the vicinity of an upper-right corner of the first flow passage member 210, and the second introduction flow passage 282*b* is arranged in the vicinity of a lower-left corner of the first flow passage member 210.

The first flow passage 241 includes a first distribution flow passage 251 that is formed by the second flow passage member 220 and the third flow passage member 230. The first distribution flow passage 251 is a part of the first flow passage 241 and through which ink flows in a direction parallel with the liquid ejecting surface 20*a*. In this embodiment, the two first flow passages 241 are formed, and thus the first distribution flow passage 251 is also formed in a number of two. The two first distribution flow passages 251 are set as a first distribution flow passage 251*a* and a first distribution flow passage 251*b*, respectively.

The first distribution flow passage 251*a* is formed by sealing together a distribution groove 226*a* that is formed in a surface on a Z1 side of the second flow passage member 220 along the Y direction, and a distribution groove 231*a* that is formed in a surface on a Z2 side of the third flow passage member 230 along the Y direction. The first distribution flow passage 251*b* is formed by sealing together a distribution groove 226*b* that is formed in the surface on the Z1 side of the second flow passage member 220 along the Y direction, and a distribution groove 231*b* that is formed in the surface on the Z2 side of the third flow passage member 230 along the Y direction.

In all of the first distribution flow passage 251*a* and 251*b*, the distribution groove 226*a* or 226*b*, and the distribution groove 231*a* or 231*b* are formed in the second flow passage member 220 and the third flow passage member 230, respectively, to increase the cross-sectional area of the first distribution flow passages 251*a* and 251*b*, and thus a pressure loss in the first distribution flow passages 251*a* and 251*b* is reduced. In addition, the first distribution flow passage 251*a* or 251*b* may be formed by the distribution groove 226*a* or 226*b* which is formed only in the second flow passage member 220, or may be formed by the distribution groove 231*a* or 231*b* which is formed only in the third flow passage member 230. For example, when the distribution groove 226*a* or 226*b* is formed only in the second flow passage member 220 on the Z2 side, as described later, it is possible to improve the degree of freedom in arrangement of the first flow passage 241 while preventing interference between the COF substrate 98 whose width in the Xa direction becomes narrow from the Z1 side toward the Z2 side, and the first distribution flow passages 251*a* and 251*b*.

The first distribution flow passage 251*a* and the first distribution flow passage 251*b* are arranged on both outer sides of the opening 201 (third opening 235), into which the COF substrate 98 is inserted so as to pass therethrough, in the X direction.

The second flow passage 242 includes the second distribution flow passage 252 that is formed by the first flow passage member 210 and the second flow passage member 220. The second distribution flow passage 252 is a part of the second flow passage 242 and through which ink flows in a direction parallel with the liquid ejecting surface 20*a*. In this embodiment, the two second flow passages 242 are formed, and thus the second distribution flow passage 252 is also formed in a number of two. The two second distribution flow passages 252 are set as a second distribution flow passage 252*a* and a second distribution flow passage 252*b*.

The second distribution flow passage 252*a* is formed by sealing together a distribution groove 213*a* that is formed in a surface on a Z1 side of the first flow passage member 210 along the Y direction, and a distribution groove 222*a* that is formed in the surface on the Z2 side of the second flow passage member 220 along the Y direction. The second distribution flow passage 252*b* is formed by sealing together a distribution groove 213*b* that is formed in the surface on the Z1 side of the first flow passage member 210, and a distribution groove 222*b* that is formed in the surface on the Z2 side of the second flow passage member 220 along the Y direction.

In all of the second distribution flow passages 252*a* and 252*b*, the distribution grooves 213*a* or 213*b*, and the distribution grooves 222*a* or 222*b* are formed in the first flow passage member 210 and the second flow passage member 220, respectively, to increase the cross-sectional area of the second distribution flow passages 252*a* and 252*b*, and thus a pressure loss in the second distribution flow passages 252*a* and 252*b* is reduced. In addition, the second distribution flow passage 252*a* or 252*b* may be formed by the distribution groove 213*a* or 213*b* which is only in the first flow passage member 210 or may be formed by the distribution groove 222*a* or 222*b* which is formed only in the second flow passage member 220. For example, when the distribution groove 222*a* or 222*b* is formed only in the first flow passage member 210 on the Z2 side, as is the case with the above-described first distribution flow passages 251*a* and 251*b*, it is possible to improve the degree of freedom in arrangement of the second flow passage 242 while preventing interference with the COF substrate 98.

The second distribution flow passage 252*a* and the second distribution flow passage 252*b* are arranged on both outer sides of the opening 201 (second opening 225), into which the COF substrate 98 is inserted so as to pass therethrough, in the X direction.

Hereinafter, when being described as the first distribution flow passage 251, the description is intended to indicate both the first distribution flow passage 251*a* and the first distribution flow passage 251*b*. When being described as the second distribution flow passage 252, the description is intended to indicate both the second distribution flow passage 252*a* and the second distribution flow passage 252*b*. In addition, when being described as the distribution flow passage 250, the description is intended to indicate all of the above-described four distribution flow passages.

In addition, in this embodiment, the first flow passage 241 is configured to diverge toward the plurality of connection portion 290 from one introduction flow passage 280. That is, a plurality of first diverging flow passages 261 diverge from the first distribution flow passage 251 on the same plane (a boundary surface at which the second flow passage member 220 and the third flow passage member 230 are bonded to each other) as the first distribution flow passage 251.

In this embodiment, in a plane (a boundary surface between the second flow passage member 220 and the third flow passage member 230) that is parallel with the liquid ejecting surface 20*a*, six first diverging flow passages 261 diverge from the first distribution flow passage 251. The six first diverging flow passages 261, which diverge from the first distribution flow passage 251*a*, are set as a first diverging flow passage 261*a*1 to a first diverging flow passage 261*a*6. Hereinafter, when being described as the first diverging flow passage 261*a*, the description is intended to indicate all of the six diverging flow passages which are connected to the first diverging flow passage 261*a*.

Similarly, six first diverging flow passages 261, which diverge from the first distribution flow passage 251*b*, are set as a first diverging flow passage 261*b*1 to a first diverging flow passage 261*b*6. Hereinafter, when being described as the first diverging flow passage 261*b*, the description is intended to indicate all of the six diverging flow passages which are connected to the first diverging flow passage 261*b*. In addition, when being described as the first diverging flow passage 261, the description is intended to indicate all of 12 diverging flow passages which are connected to the first diverging flow passage 261*a* and the first diverging flow passage 261*b*, respectively.

In addition, among the six first diverging flow passage 261*a*1 to the first diverging flow passage 261*a*6 which are arranged in the Y direction in the drawings, reference numerals of the first diverging flow passage 261*a*2 to the first diverging flow passage 261*a*5 are omitted, but it is assumed that these are sequentially arranged from the Y1 side toward the Y2 side. This assumption is also true of the first diverging flow passage 261*b*1 to the first diverging flow passage 261*b*6.

Specifically, a plurality of diverging grooves 232*a*, which communicate with the diverging groove 231*a* and extend toward the opening 201 side, are provided in the surface on the Z2 side of the third flow passage member 230. A plurality of diverging grooves 227*a*, which communicate with the diverging groove 226*a* and extend toward the opening 201, are provided in the surface on the Z1 side of the second flow passage member 220. The first diverging flow passage 261*a* is formed when each diverging groove 227*a* and each diverging groove 232*a* face each other and are sealed.

A plurality of diverging grooves 232*b*, which communicate with the diverging groove 231*b* and extend toward the opening 201 side, are provided in the surface on the Z2 side of the third flow passage member 230. A plurality of diverging grooves 227*b*, which communicate with the diverging groove 226*b* and extend toward the opening 201 side, are provided in the surface on the Z1 side of the second flow passage member 220. The first diverging flow passage 261*b* is formed when each diverging groove 227*b* and each diverging groove 232*b* face each other and are sealed.

In all of the first diverging flow passages 261*a* and 261*b*, the diverging groove 227*a* or 227*b*, and the diverging groove 232*a* or 232*b* are formed in the second flow passage member 220 and the third flow passage member 230, respectively, to increase the cross-sectional area of the first diverging flow passages 261*a* and 261*b*. Accordingly, a pressure loss in the first diverging flow passages 261*a* and 261*b* is reduced. In addition, the first diverging flow passage 261*a* or 261*b* may be formed by the diverging groove 227*a* or 227*b* which is formed only in the second flow passage member 220, or may be formed by the diverging groove 232*a* or 232*b* which is formed only in the third flow passage member 230. For example, as described later, in a region Q which is inclined in the Ya direction, and in which a width in the Ya direction increases from the Z1 side toward the Z2 side, when the diverging groove 227*a* or 227*b* is formed only in the second flow passage member 220 on the Z2 side, it is possible to improve the degree of freedom in arrangement of the first flow passage 241 while preventing interference with the COF substrate 98. In addition, in a region P in which a width in the Ya direction increases from the Z2 side toward the Z1 side, when the diverging groove 232*a* or 232*b* is formed only in the third flow passage member 230 on the Z1 side, it is possible to improve the degree of freedom in arrangement of the first flow passage 241 while preventing interference with the COF substrate 98.

In addition, the second flow passage 242 is configured to diverge from one introduction flow passage 280 toward the plurality of connection portions 290. Although details will be described later, a plurality of second diverging flow passages 262 diverge from the second distribution flow passage 252 on the same plane (a boundary surface at which the first flow passage member 210 and the second flow passage member 220 are bonded to each other) as the second distribution flow passage 252.

In this embodiment, in a plane (a boundary surface between the first flow passage member 210 and the second flow passage member 220) that is parallel with the liquid ejecting surface 20*a*, six second diverging flow passages 262 diverge from the second distribution flow passage 252. The six second diverging flow passages 262, which diverge from the second distribution flow passage 252*a*, are set as a second diverging flow passage 262*a*1 to a second diverging flow passage 262*a*6.

Similarly, six second diverging flow passages 262, which diverge from the second distribution flow passage 252*b*, are set as a second diverging flow passage 262*b*1 to a second diverging flow passage 262*b*6.

Hereinafter, when being described as the second diverging flow passage 262*a*, the description is intended to indicate all of the six diverging flow passages which are connected to the second diverging flow passage 262*a*. In addition, when being described as the second diverging flow passage 262*b*, the description is intended to indicate all of the six diverging flow passages which are connected to the second diverging flow passage 262*b*. In addition, when being described as the second diverging flow passage 262, the description is intended to indicate all of 12 diverging flow passages which are connected to the second diverging flow passage 262*a* and the second diverging flow passage 262*b*, respectively. In addition, when being described as the diverging flow passage 260, the description is intended to indicate all of the above-described 24 diverging flow passages.

In addition, among the six second diverging flow passage 262*a*1 to the second diverging flow passage 262*a*6 which are arranged in the Y direction in the drawings, reference numerals of the second diverging flow passage 262*a*2 to the second diverging flow passage 262*a*5 are omitted, but it is assumed that these are sequentially arranged from the Y1 side toward the Y2 side. This assumption is also true of the second diverging flow passage 262*b*1 to the second diverging flow passage 262*b*6.

Specifically, a plurality of diverging grooves 223*a*, which communicate with the diverging groove 222*a* and extend toward the opening 201 side, are provided in the surface on the Z2 side of the second flow passage member 220. A plurality of diverging grooves 214*a*, which communicate with the diverging groove 213*a* and extend toward the opening 201 side, are provided in the surface on the Z1 side of the first flow passage member 210. The second diverging flow passage 262*a* is formed when each diverging groove 214*a* and each diverging groove 223*a* face each other and are sealed.

A plurality of diverging grooves 223*b*, which communicate with the diverging groove 222*b* and extend toward the opening 201 side, are provided in the surface on the Z2 side of the second flow passage member 220. A plurality of diverging grooves 214*b*, which communicate with the diverging groove 213*b* and extend toward the opening 201 side, are provided in the surface on the Z1 side of the first flow passage member 210. The second diverging flow passage 262*b* is formed when each diverging groove 214*b* and each diverging groove 223*b* face each other and are sealed.

In all of the second diverging flow passages 262*a* and 262*b*, the diverging groove 214*a* or 214*b*, and the diverging groove 223*a* or 223*b* are formed in the first flow passage member 210 and the second flow passage member 220, respectively, to increase the cross-sectional area of the second diverging flow passages 262*a* and 262*b*. Accordingly, a pressure loss in the second diverging flow passages 262*a* and 262*b* is reduced. In addition, the second diverging flow passage 262*a* or 262*b* may be formed by the diverging groove 214*a* or 214*b* which is formed only in the first flow passage member 210, or may be formed by the diverging groove 223*a* or 223*b* which is formed only in the second flow passage member 220. For example, as described later, in a region which is inclined in the Ya direction, and in which a width in the Ya direction increases from the Z1 side toward the Z2 side, when the diverging groove 214*a* or 214*b* is formed only in the first flow passage member 210 on the Z2 side, it is possible to improve the degree of freedom in arrangement of the second flow passage 242 while preventing interference with the COF substrate 98. In addition, in a region in which a width in the Ya direction increases from the Z2 side toward the Z1 side, when the diverging groove 223*a* or 223*b* is formed only in the second flow passage member 220 on the Z1 side, it is possible to improve the degree of freedom in arrangement of the second flow passage 242 while preventing interference with the COF substrate 98.

A first vertical flow passage 271 is connected to the first diverging flow passage 261 on an end that is opposite to the first distribution flow passage 251. Specifically, a first vertical flow passage 271 is formed as a through-hole that passes through the third flow passage member 230 in the Z direction.

In this embodiment, a total of 12 first vertical flow passages 271*a*1 to 271*a*6, and 271*b*1 to 271*b*6 are connected to the first diverging flow passages 261*a*1 to 261*a*6, and 261*b*1 to 261*b*6, respectively, in a one-to-one relation.

Similarly, a second vertical flow passage 272 is connected to the second diverging flow passage 262 on an end that is opposite to the second distribution flow passage 252. Specifically, a through-hole 224 is provided in the second flow passage member 220 so as to pass therethrough in the Z direction, and a through-hole 233 is provided in the third flow passage member 230 so as to pass therethrough in the Z direction. The through-holes 224 and 233 communicate with each other and thus the second vertical flow passage 272 is formed.

In this embodiment, a total of 12 second vertical flow passages 272*a*1 to 272*a*6, and 272*b*1 to 272*b*6 are connected to the second diverging flow passages 262*a*1 to 262*a*6, and 262*b*1 to 262*b*6, respectively, in a one-to-one relation.

Hereinafter, when being described as the first vertical flow passage 271*a*, the description is intended to indicate the first vertical flow passages 271*a*1 to 271*a*6, and when being described as the first vertical flow passage 271*b*, the description is intended to indicate the first vertical flow passages 271*b*1 to 271*b*6. In addition, when being described as the first vertical flow passage 271, the description is intended to indicate all of the first vertical flow passage 271*a* and the first vertical flow passage 271*b*.

Similarly, when being described as the second vertical flow passage 272*a*, the description is intended to indicate the second vertical flow passages 272*a*1 to 272*a*6, and when being described as the second vertical flow passage 272*b*, the description is intended to indicate the second vertical flow passages 272*b*1 to 272*b*6. In addition, when being described as the second vertical flow passage 272, the description is intended to indicate all of the second vertical flow passage 272*a* and the second vertical flow passage 272*b*.

In addition, when being described as the vertical flow passage 270, the description is intended to indicate all of the above-described 24 vertical flow passages.

In addition, among the six first vertical flow passages 271*a*1 to the first vertical flow passages 271*a*6 which are arranged in the Y direction in the drawings, reference numerals of the first vertical flow passage 271*a*2 to the first vertical flow passage 271*a*5 are omitted in the drawings, but it is assumed that these are sequentially arranged from the Y1 side toward the Y2 side. This assumption is also true of the first vertical flow passage 271*b*1 to the first vertical flow passage 271*b*6, the second vertical flow passage 272*a*1 to the second vertical flow passage 272*a*6, and the second vertical flow passage 272*b*1 to the second vertical flow passage 272*b*6.

The above-described vertical flow passage 270 includes the connection portion 290 that is an opening on a Z1 side of the third flow passage member 230. Although details will be described later, the connection portion 290 communicates with an introduction passage 44 provided in the head main body 110.

In this embodiment, the first vertical flow passages 271*a*1 to 271*a*6, and the first vertical flow passages 271*b*1 to 271*b*6 include first connection portions 291*a*1 to 291*a*6 and first connection portions 291*b*1 to 291*b*6, which are openings on a Z1 side of the third flow passage member 230, respectively. Similarly, the second vertical flow passages 272*a*1 to 272*a*6, and the second vertical flow passages 272*b*1 to 272*b*6 include second connection portions 292*a*1 to 292*a*6 and the second connection portions 292*b*1 to 292*b*6, which are openings on the Z1 side of the third flow passage member 230, respectively.

The first connection portions 291*a*1, the first connection portion 291*b*1, the second connection portion 292*a*1, and the second connection portion 292*b*1 are connected to one of six head main bodies 110. In addition, this is true of the first connection portions 291*a*2 to 291*a*6, the first connection portions 291*b*2 to 291*b*6, the second connection portions 292*a*2 to 292*a*6, and the second connection portions 292*b*2 to 292*b*6. That is, the first flow passage 241*a*, the first flow passage 241*b*, the second flow passage 242*a*, and the second flow passage 242*b* are connected to one head main body 110.

Hereinafter, when being described as the first connection portion 291*a*, the description is intended to indicate the first connection portions 291*a*1 to 291*a*6, and when being described as the first connection portion 291*b*, the description is intended to indicate the first connection portions 291*b*1 to 291*b*6. In addition, when being described as the first connection portion 291, the description is intended to indicate all of the first connection portion 291*a* and the first connection portion 291*b*.

Similarly, when being described as the second connection portion 292*a*, the description is intended to indicate the second connection portions 292*a*1 to 292*a*6, and when being described as the second connection portion 292*b*, the description is intended to indicate the second connection portions 292*b*1 to 292*b*6. In addition, when being described as the second connection portion 292, the description is intended to indicate all of the second connection portion 292*a* and the second connection portion 292*b*.

In addition, when being described as the connection portion 290, the description is intended to indicate all of the above-described 24 connection portions.

As described above, the flow passage member 200 according to this embodiment includes four flow passages 240, that is, the first flow passages 241*a* and 241*b*, and the second flow passages 242*a* and 242*b*. In addition, in each flow passage 240, a region ranging from the introduction flow passage 280, to which ink is introduced, to distribution flow passage 250 is configured as one flow passage, diverges from the distribution flow passage 250 toward the diverging flow passage 260, and is connected to the plurality of head main bodies 110 through the vertical flow passage 270 and the connection portion 290.

In this embodiment, four colors of ink, which include black Bk, magenta M, cyan C, and yellow Y, are used. The cyan C, the yellow Y, the black Bk, and the magenta M are supplied to the first flow passage 241*a*, the first flow passage 241*b*, the second flow passage 242*a*, and the second flow passage 242*b*, respectively, from liquid storage units (not illustrated). In addition, the respective colors of ink flow through the first flow passage 241*a*, the first flow passage 241*b*, the second flow passage 242*b*, and the second flow passage 242*b*, and are supplied to the head main body 110.

Here, the opening 201, into which the COF substrate 98 provided to the head main body 110 is inserted so as to pass therethrough, is provided to the flow passage member 200. In this embodiment, a first opening 215 inclined in the Z direction is formed in the first flow passage member 210 so as to pass therethrough. A second opening 225 inclined in the Z direction is formed in the second flow passage member 220 so as to pass therethrough. A third opening 235 inclined in the Z direction is formed in the third flow passage member 230 so as to pass therethrough.

The first opening 215, the second opening 225, and the third opening 235 communicate with each other, and constitute one opening 201. The opening 201 has an opening shape that elongates in the Xa direction, and six openings 201 are arranged in parallel in the Y direction.

Figure 16:
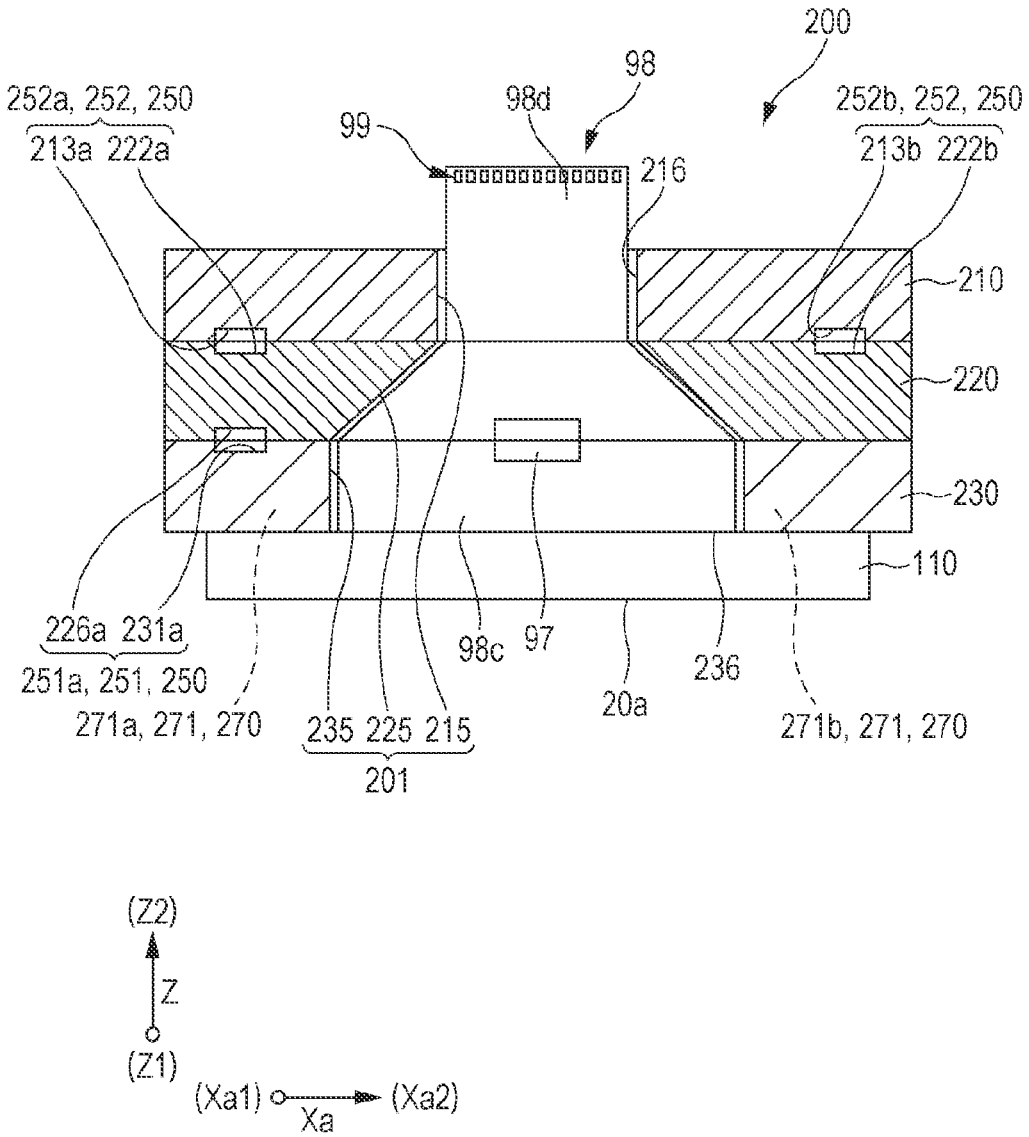
FIG. 16 is a cross-sectional view taken along line XVI-XVI in FIGS. 10 to 15.

Here, as illustrated in FIG. 16, the COF substrate according to this embodiment includes a lower end 98*c* that is one end close to the head main body 110 in the Z direction, and an upper end 98*d* that is the other end distant from the head main body 110 in the Z direction. A width of the upper end 98*d* in the Xa direction is set to be narrower than a width of the lower end 98*c* in the Xa direction. That is, with regard to a width of the flexible interconnection substrate 98 in a plane direction, the other end is formed to be narrower than the one end.

In this embodiment, a portion of the COF substrate 98, which is inserted into the first opening 215 and the third opening 235 so as to pass therethrough, has a rectangular shape that has a constant width in the Xa direction, and a portion of the COF substrate 98, which is inserted into the second opening 225 so as to pass therethrough, has a trapezoidal shape in which a width in the Xa direction decreases from the Z1 side toward the Z2 side.

On the other hand, the opening 201 of the flow passage member 200 includes a first opening 236 (that is, an opening on a Z1 side of the third opening 235) that is close to the head main body 110 in the Z direction perpendicular to the liquid ejecting surface 20*a*, and a second opening 216 (that is, an opening on a Z2 side of the first opening 215) that is distant from the head main body 110.

The second opening 216 is formed to be narrower than the first opening 236 in the Xa direction. That is, as the opening 201, a width in the Xa direction decreases from the Z1 toward Z2 in the Z direction. Specifically, the opening 201 is formed in a shape in which the COF substrate 98 is accommodated, and the width of the opening 201 in the Xa direction is set to be slightly broader than the width of the COF substrate 98 in the Xa direction.

Other Embodiments

Hereinbefore, an embodiment of the invention has been described, but the basic configuration of the invention is not limited to the above-described configuration.

For example, in the first embodiment, the head main bodies 110 are arranged in parallel in the Y direction, and the recording head 100 is constituted by the plurality of head main bodies 110, but the recording head 100 may be constituted by one head main body 110. In addition, the number of the recording heads 100 which are included in the head unit 101 is not particularly limited, and two or more recording heads 100 may be mounted, or as a single body, one recording head 100 may be mounted on the ink jet type recording apparatus 1.

The above-described ink jet type recording apparatus 1 is a so-called line type recording apparatus in which the head unit 101 is in a fixed state, and the recording sheet S is transported to perform printing, but the configuration of the line type recording apparatus is not limited to the above-described configuration, and a configuration in which heads are arranged in a zigzag manner is also possible. In addition, the invention is applicable to a so-called serial type recording apparatus in which the head unit 101 or one or a plurality of recording heads 100 are mounted on a carriage, and the head unit 101 or the recording head 100 is allowed to move in a main scanning direction intersecting the transporting direction of the recording sheet S, and the recording sheet S is transported to perform printing without limitation to the line type recording apparatus.

In addition, as an external connection terminal row, a connection connector is used when considering that connection and detachment of an interconnection from the outside is easy, but there is no limitation thereto, and a terminal row that connects an FPC and the like through an ACF, an ACP, and the like are also possible.

In addition, an FPC substrate is exemplified as an interconnection from the outside, a COF substrate, a connection cable, and the like are also possible.

In addition, a relay substrate is used, but it is not necessary to use the relay substrate, and the interconnection from the outside may be connected to each drive system connection connector, and each control system connection connector.

In addition, the first flow passage member 210 and the second flow passage member 220 are bonded to each other so as to form the second flow passage 242, and the second flow passage member 220 and the third flow passage member 230 are bonded to each other so as to form the first flow passage 241, but a method of forming the first flow passage 241 and the second flow passage 242 is not limited thereto. For example, two or more flow passage members may be integrally shaped without bonding thereof by using a laminating and shaping method capable of performing three-dimensional shaping. In addition, an individual flow passage member may be formed by three-dimensional shaping, mold molding (injection molding, and the like), cutting, or pressing.

In addition, as the flexible interconnection substrate, the COF substrate 98 is provided, but a flexible printed substrate (FPC) is also possible.

In addition, the invention is broadly targeted to whole liquid ejecting head units, and for example, the invention is also applicable to liquid ejecting head units provided with recording heads such as various ink jet type recording heads that are used for an image recording apparatus such as a printer, a color material ejecting head that is used to manufacture color filters of a liquid crystal display and the like, an electrode material ejecting head that is used to form electrodes of an organic EL display, a field emission display (FED), and the like, a biogenic organic material ejecting head that is used to manufacture a biochip, and the like.

In addition, the interconnection substrate of the invention is not limited to a use for the liquid ejecting head, and is applicable to an arbitrary electronic circuit, and the like.

What is claimed is:

1. A liquid ejecting head, comprising:

a plurality of actuator units, each including a connection terminal row;

an interconnection substrate which is disposed to face the plurality of actuator units, is electrically connected to the connection terminal row of each of the plurality of actuator units, and extends in a second direction intersecting a first direction that is a transporting direction of a recording sheet;

an external connection terminal row which is provided to the interconnection substrate, and supplies a signal supplied from the outside to each of the plurality of actuator units through the interconnection substrate; and a plurality of liquid flow passages which supply a liquid to each of the plurality of actuator units from a side opposite to a side in which the plurality of actuator units are disposed with the interconnection substrate set as a reference, wherein the plurality of liquid flow passages are arranged on an outer side of the interconnection substrate in the first direction, and the external connection terminal row is arranged between the plurality of liquid flow passages in the second direction.

2. The liquid ejecting head according to claim 1, wherein the plurality of liquid flow passages are arranged on both outer sides of the interconnection substrate in the first direction, and the external connection terminal row is arranged by being divided into parts on both sides of the interconnection substrate in the first direction, and each of the divided external connection terminal rows is arranged between the plurality of liquid flow passages in the second direction.

3. The liquid ejecting head according to claim 2, wherein one of the divided external connection terminal rows is a control system external connection terminal row that supplies a control signal configured to control a semiconductor device that is mounted on the plurality of actuator units, and the other is a drive system external connection terminal row that supplies a control signal configured to drive a drive element that is provided to the plurality of actuator units.

4. The liquid ejecting head according to claim 1, wherein each of the connection terminal rows is electrically connected to the interconnection substrate in a direction that is parallel with or inclined to the first direction.

5. A liquid ejecting apparatus, comprising:

the liquid ejecting head according to claim 1.

* * * * *